US007308808B2

(12) United States Patent
Hallman et al.

(10) Patent No.: US 7,308,808 B2
(45) Date of Patent: Dec. 18, 2007

(54) APPARATUS AND METHOD FOR ARTICLE CLEANING

(75) Inventors: Darren Lee Hallman, Clifton Park, NY (US); David Joseph Najewicz, Prospect, KY (US); Sung Jin Kim, Guilderland, NY (US); Andrew Denise Varghese, Bangalore (IN); Thomas Joseph Fyvie, Schenectady, NY (US); Teresa Grocela-Rocha, Waterford, NY (US); Vanita Mani, Clifton Park, NY (US); Warren Frank Bessler, Amsterdam, NY (US)

(73) Assignee: General Electric Company, Niskayuna, NY (US)

( * ) Notice: Subject to any disclaimer, the term of this patent is extended or adjusted under 35 U.S.C. 154(b) by 95 days.

(21) Appl. No.: 10/127,001

(22) Filed: Apr. 22, 2002

(65) Prior Publication Data

US 2003/0196277 A1 Oct. 23, 2003

(51) Int. Cl.
*D06B 23/20* (2006.01)

(52) U.S. Cl. ..... 68/18 C; 68/18 R; 68/20

(58) Field of Classification Search ..... 68/18 C, 68/18 F, 18 R, 207, 19.2, 20, 24; 134/109, 134/159

See application file for complete search history.

(56) References Cited

U.S. PATENT DOCUMENTS

| | | | | | |
|---|---|---|---|---|---|
| 1,776,190 | A | * | 9/1930 | Mishaw | 68/139 |
| 2,019,011 | A | * | 10/1935 | Johnson | 68/18 R |
| 2,114,776 | A | * | 4/1938 | Davis | 68/18 R |
| 2,146,262 | A | * | 2/1939 | Johnson | 68/20 |
| 2,768,869 | A | * | 10/1956 | Creswick | 8/158 |
| 2,777,534 | A | * | 1/1957 | McDonald | 96/112 |
| 2,941,389 | A | * | 6/1960 | Morrison | 68/20 |
| 2,979,375 | A | * | 4/1961 | Kircher, Jr. et al. | 8/142 |
| 3,065,617 | A | * | 11/1962 | Fuhring | 68/12.08 |
| 3,106,831 | A | * | 10/1963 | Behrens | 68/12.08 |
| 3,133,286 | A | * | 5/1964 | Brucken et al. | 68/18 F |
| 3,246,493 | A | * | 4/1966 | Oles | 68/18 R |

(Continued)

FOREIGN PATENT DOCUMENTS

EP 0 543 665 A1 11/1992

(Continued)

OTHER PUBLICATIONS

WO93/01345 Jan. 1993 (Onodera).*

(Continued)

*Primary Examiner*—Frankie L. Stinson
(74) *Attorney, Agent, or Firm*—Jason K. Klindtworth; Jean K. Testa

(57) ABSTRACT

The present invention provides an article cleaning apparatus comprising an air management mechanism, a cleaning basket assembly, a fluid regeneration device, a working fluid device, a clean fluid device, and a controller. The working fluid device is coupled to the fluid regeneration device, the cleaning basket assembly, and the air management mechanism. The clean fluid device is coupled to the cleaning basket assembly and the fluid regeneration device. The controller is coupled to the air management mechanism, the cleaning basket assembly, the working fluid device, the regeneration device, and the clean fluid device. The controller is configured to control a cleaning process. The present invention also provides a method for performing the cleaning process.

11 Claims, 16 Drawing Sheets

U.S. PATENT DOCUMENTS 3,295,339 A * 1/1967 Cheyne ..... 68/18 F
3,402,576 A * 9/1968 Krupsky ..... 68/4
3,583,181 A * 6/1971 Brillet ..... 68/18 F
3,583,567 A 6/1971 Maestrelli
3,613,135 A * 10/1971 Fuhring et al. ..... 8/158
3,840,340 A * 10/1974 McKnight ..... 8/142
3,931,011 A 1/1976 Richards et al.
4,074,984 A * 2/1978 Fuhring ..... 96/114
4,115,061 A * 9/1978 Grunewalder ..... 8/137
4,138,337 A 2/1979 Smith
4,279,704 A 7/1981 Noble, Sr. et al.
4,283,279 A 8/1981 Smith
4,298,465 A 11/1981 Druffel
4,444,625 A 4/1984 Smith
4,456,529 A 6/1984 Shinaver
4,513,590 A * 4/1985 Fine ..... 68/18 C
4,661,612 A 4/1987 George et al.
4,685,930 A 8/1987 Kasprzak
4,765,159 A 8/1988 Maeda et al.
4,774,346 A 9/1988 Imai et al.
4,781,041 A * 11/1988 Fowler ..... 68/18 F
4,813,247 A * 3/1989 Takeda ..... 68/18 C
4,840,065 A 6/1989 Arbizzani
4,938,845 A * 7/1990 Kohler ..... 202/169
5,225,509 A 7/1993 Heinrich et al.
5,226,203 A * 7/1993 Sacconato et al. ..... 8/159
5,236,580 A 8/1993 Kelleher
5,238,899 A 8/1993 Kadowaki et al.
5,245,067 A 9/1993 Schneider et al.
5,288,831 A 2/1994 Ichinohe et al.
5,327,751 A * 7/1994 Biagi ..... 68/18 C
5,493,124 A 2/1996 Shapiro
5,520,028 A 5/1996 Kim et al.
5,603,233 A 2/1997 Erickson et al.
5,649,372 A * 7/1997 Souza ..... 34/491
5,731,868 A 3/1998 Okey et al.
5,783,078 A 7/1998 Roll et al.
5,860,796 A 1/1999 Clausen et al.
5,864,140 A 1/1999 Owens
5,876,461 A * 3/1999 Racette et al. ..... 8/137
5,905,648 A 5/1999 Badami
5,940,988 A * 8/1999 Eisen ..... 34/596
5,942,007 A 8/1999 Berndt et al.
5,997,739 A 12/1999 Clausen et al.
6,042,617 A 3/2000 Berndt
6,042,618 A 3/2000 Berndt et al.
6,056,789 A 5/2000 Berndt et al.
6,059,845 A * 5/2000 Berndt et al. ..... 8/142
6,063,135 A 5/2000 Berndt et al.
6,086,635 A 7/2000 Berndt et al.
6,203,698 B1 3/2001 Goodrich
6,309,425 B1 10/2001 Murphy
6,313,079 B1 11/2001 Murphy
6,313,468 B1 11/2001 Wedekamp
6,360,585 B1 3/2002 Potyrailo et al.
6,494,964 B1 12/2002 Jacobs et al.
6,509,558 B1 1/2003 Loch et al.
6,516,817 B2 2/2003 Jacobs et al.
6,516,818 B2 2/2003 Jacobs et al.
6,519,034 B1 2/2003 Engler et al.
6,534,319 B1 3/2003 Liu
6,536,059 B2 * 3/2003 McClain et al. ..... 8/158
6,536,060 B1 3/2003 Janssens et al.
6,607,663 B1 * 8/2003 Dixon ..... 210/195.2
6,691,536 B2 * 2/2004 Severns et al. ..... 68/12.27
6,814,875 B2 * 11/2004 Muroi et al. ..... 210/748
6,840,069 B2 * 1/2005 France et al. ..... 68/12.02
2002/0073491 A1 * 6/2002 Mettlach et al. ..... 8/149.1
2003/0019048 A1 1/2003 Perry et al.
2003/0110658 A1 6/2003 Treur et al.
2003/0226214 A1 * 12/2003 Radomyselski et al. ..... 8/137

FOREIGN PATENT DOCUMENTS

JP 2-57296 * 2/1990
JP 02057296 2/1990
JP 3-237999 * 10/1991
JP 4-141196 * 5/1992
JP 5-192492 * 8/1993
JP 10-272289 * 10/1998

OTHER PUBLICATIONS

"Dahl Fuel Filter Water Separator", Pecuniary, Inc. 10 pages (www.diesel-fuels.com).
"Turbine Series Fuel Filter/Water Separator", Mid-Atlantic Engine Supply Corp., 10 pages (www.maesco.com).

* cited by examiner

APPARATUS AND METHOD FOR ARTICLE CLEANING

BACKGROUND OF INVENTION

Conventional household clothing washers use anywhere from about 60 liters to about 190 liters of water to wash a typical load of clothing articles. The spent water and cleaning agents are then dumped into sewage. Furthermore, the water is frequently heated to improve wash effectiveness and usually requires a large amount of energy to be put into the articles as heat in order to vaporize the retained water and dry the articles. The combination of high water usage, high-energy usage and disposal of cleaning additives in the detergent can put a large strain on the environment.

Conventional perchloroethylene (PERC) professional dry cleaning solvent has been shown to be hazardous to human health as well as to the environment. Use of a cyclic siloxane composition as a replacement for PERC is described in Kasprzak, U.S. Pat. No. 4,685,930 and Dullien et al., U.S. Pat. No. 6,063,135. The use of a siloxane solvent in laundering has been shown to result in reduced wrinkling, superior article care, and better finish than water washing. Furthermore, the siloxane solvent has a lower heat of vaporization than water. Compared to water, the siloxane solvent can be more easily dried out of the article. If a washing machine contained a solvent based cleaning cycle, the solvent cycle could replace some or all of the washing currently being done in water, which would result in a significant reduction in energy and water use.

There are currently commercial dry cleaning machines, which use a cyclic siloxane dry cleaning process, but these machines present several barriers to in-home use. Conventional commercial dry cleaning machines are generally much larger than typical home washing machines, and would not fit within typical washrooms. The commercial dry cleaning machines typically require high voltage power (>250V) and often require separate steam systems, compressed air systems, and chilling systems to be attached externally. The solvent amount generally stored in the commercial dry cleaning machines is usually more than about 190 liters, even for the smallest capacity commercial machines. The typical dry cleaning facility has both solvent cleaning and water cleaning machines on the premises and uses each machine for their separate functions. The prior art commercial dry cleaning machines are typically designed to be operated by a skilled employee and do not contain appropriate safety systems for either in-home locations or for general use. In many states, the use of commercial dry cleaning machines by the general public is forbidden.

What is needed is an article cleaning apparatus, which can be accommodated in an in-home or coin-op laundry setting. It would additionally be desirable to have an article cleaning apparatus with the option to clean with either solvent or water. An article cleaning apparatus that could also perform the drying function typically performed in the dryer would further be desired.

BRIEF DESCRIPTION

The present invention provides an article cleaning apparatus comprising an air management mechanism, a cleaning basket assembly, a fluid regeneration device, a working fluid device, a clean fluid device, and a controller. The working fluid device is coupled to the fluid regeneration device, the cleaning basket assembly, and the air management mechanism. The clean fluid device is coupled to the cleaning basket assembly and the fluid regeneration device. The controller is coupled to the air management mechanism, the cleaning basket assembly, the working fluid device, the regeneration device, and the clean fluid device. The controller is configured to control a cleaning process.

The present invention provides a method for performing the cleaning process, whereby an operator has a choice between using the article cleaning apparatus for performing a solvent cleaning process or performing a water cleaning process.

The present invention provides a method for performing a cleaning process, whereby an operator has a choice between using an article cleaning apparatus for performing a solvent cleaning process, performing a water cleaning process, performing a basket drying process, and performing a timed basket drying process.

LIST OF FIGURES

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
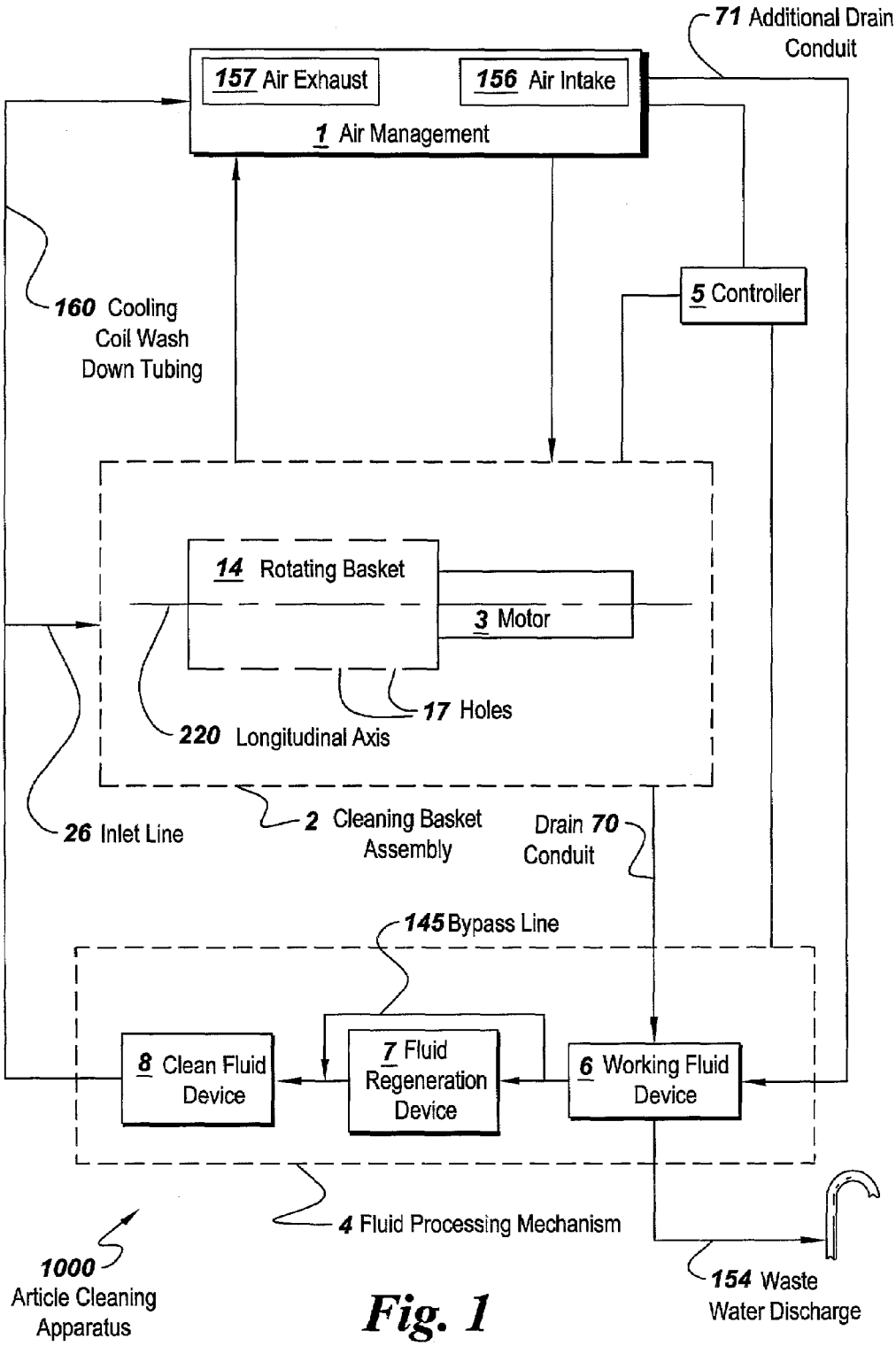
FIG. 1 is a block diagram of the article cleaning apparatus in accordance with one embodiment of the present invention.

The present invention includes an apparatus and method for the cleaning of articles at home or in a coin-op laundry setting. As used herein, the term, "articles" is defined, for illustrative purposes and without limitation, as fabrics, textiles, garments, and linens and any combination thereof. As used herein, the term, "solvent based cleaning fluid" is defined for illustrative purposes and without limitation, as comprising a cyclic siloxane solvent and, optionally, a cleaning agent. If water is present in a solvent based cleaning fluid, the water is present in an amount in a range from about 1 percent to about 8 percent of the total weight of the solvent based cleaning fluid. In another embodiment of the present invention, if water is present in the solvent based cleaning fluid, the water is present in an amount in a range from about 1 percent to about 2 percent of the total weight of the solvent based cleaning fluid. As used herein, the term, "cleaning agent" is defined for illustrative purposes and without limitation, as being selected from the group consisting of sanitizing agents, emulsifiers, surfactants, detergents, bleaches, softeners, and combinations thereof. As used herein, the term, "water based cleaning fluid" is defined for illustrative purposes and without limitation, as comprising water and, optionally, a cleaning agent. In the present invention, the article cleaning apparatus 1000 of FIG. 1 is configured to perform a cleaning process 350 of FIG. 11. As used herein, the term, "cleaning process" is defined, for illustrative purposes and without limitation, as utilizing a solvent cleaning process 375, a water cleaning process 600, and any combination thereof. The solvent cleaning process 375 and the water cleaning process 600 are presented in more detail after the article description of the cleaning apparatus 1000 of FIG. 1. It is recognized that alternative configurations of the article cleaning apparatus 1000 are possible.

The article cleaning apparatus 1000 comprises the air management mechanism 1, the cleaning basket assembly 2, and a fluid regeneration device 7. The article cleaning apparatus 1000 further comprises a working fluid device 6 that is coupled to the fluid regeneration device 7, the cleaning basket assembly 2, and the air management mechanism 1. The article cleaning apparatus 1000 further comprises a clean fluid device 8 that is coupled to the cleaning basket assembly 2 and the fluid regeneration device 7. The article cleaning apparatus 1000 further comprises a controller 5 which is coupled to the air management mechanism 1, the cleaning basket assembly 2, the working fluid device 6, the regeneration device 7, and the clean fluid device 8. The controller 5 is configured to perform the cleaning process 350.

The cleaning basket assembly 2 of FIG. 1 typically comprises a rotating basket 14 coupled to a motor 3. The rotating basket 14 has a plurality of holes 17. The motor 3 rotates the rotating basket 14. Suitable drive system alternatives, presented for illustration and without limitation include, direct drive, pulley-belt drive, transmissions, and any combination thereof. The direct drive orientation of the rotating basket 14 and the motor 3 is provided for illustrative purposes and it is not intended to imply a restriction to the present invention. In one embodiment of the present invention (not shown in FIG. 1), the motor 3 has a different major longitudinal axis than the longitudinal axis 220 of the rotating basket 14, and the motor 3 is coupled to the rotating basket 14 by a pulley and a belt.

Figure 2:
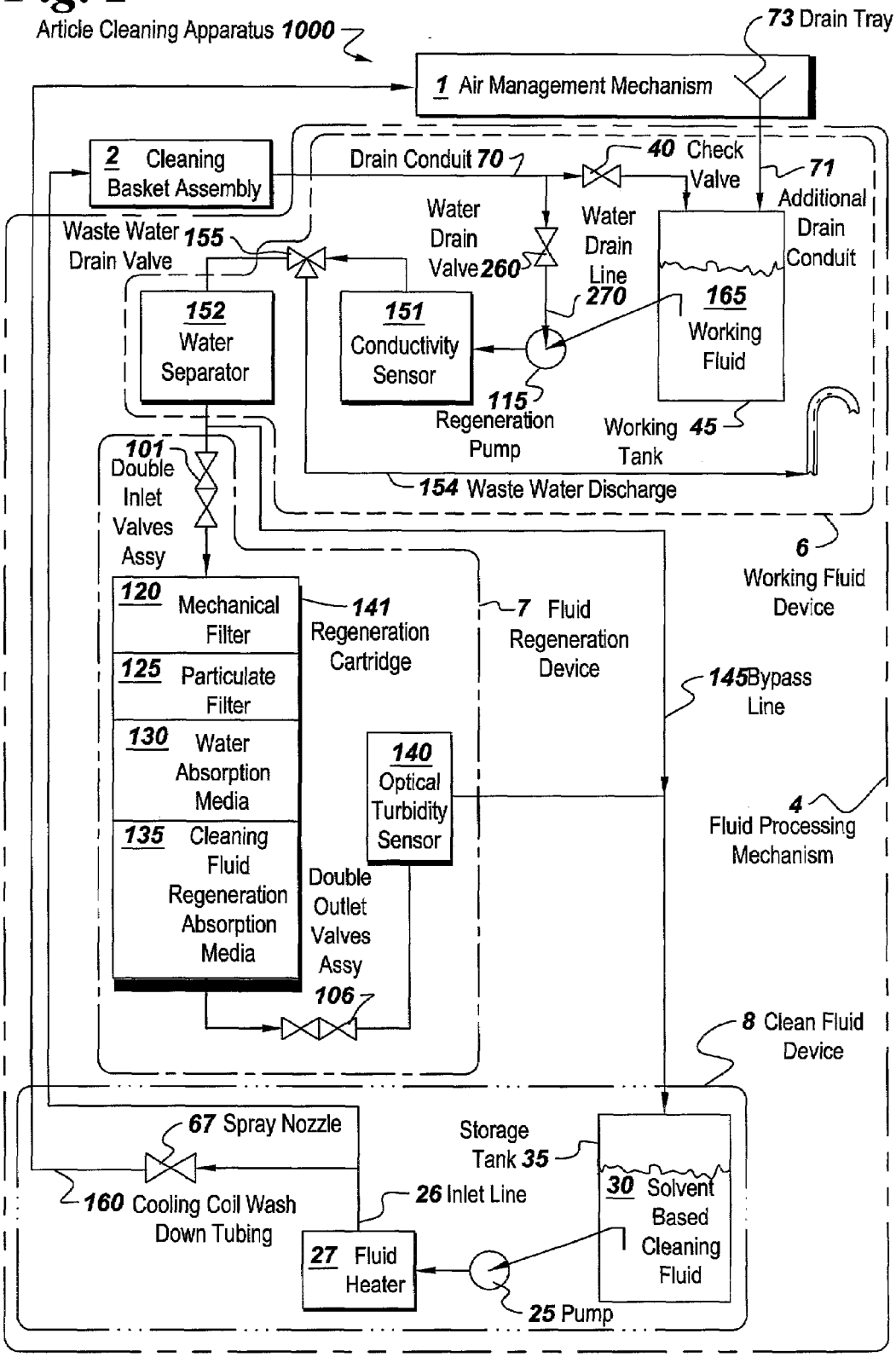
FIG. 2 is a schematic diagram of the fluid processing mechanism in accordance with one embodiment of the present invention.

As shown in FIG. 2, the working fluid device 6, the fluid regeneration device 7, and the clean fluid device 8 comprise a fluid processing mechanism 4.

In one embodiment of the present invention, the working fluid device 6 comprises a check valve 40 in a drain conduit line 70 that couples the cleaning basket assembly 2 to a working tank 45. Fluid from the cleaning basket assembly 2 passes through the check valve 40 and is collected in the working tank 45. The fluid in the working tank 45 is defined as a working fluid 165. A drain tray 73 is disposed in the air management mechanism 1 to collect condensate. An additional drain conduit 71 couples the working tank 45 to the drain tray 73. Condensate in the drain tray 73 is typically gravity drained to the working tank 45, where it is collected as part of the working fluid 165. A regeneration pump 115 is coupled to the working tank 45 and to a conductivity sensor 151. A waste water drain valve 155 is disposed between the conductivity sensor 151 and the fluid regeneration device 7. The waste water drain valve 155 is coupled to waste water discharge piping 154.

Figure 7:
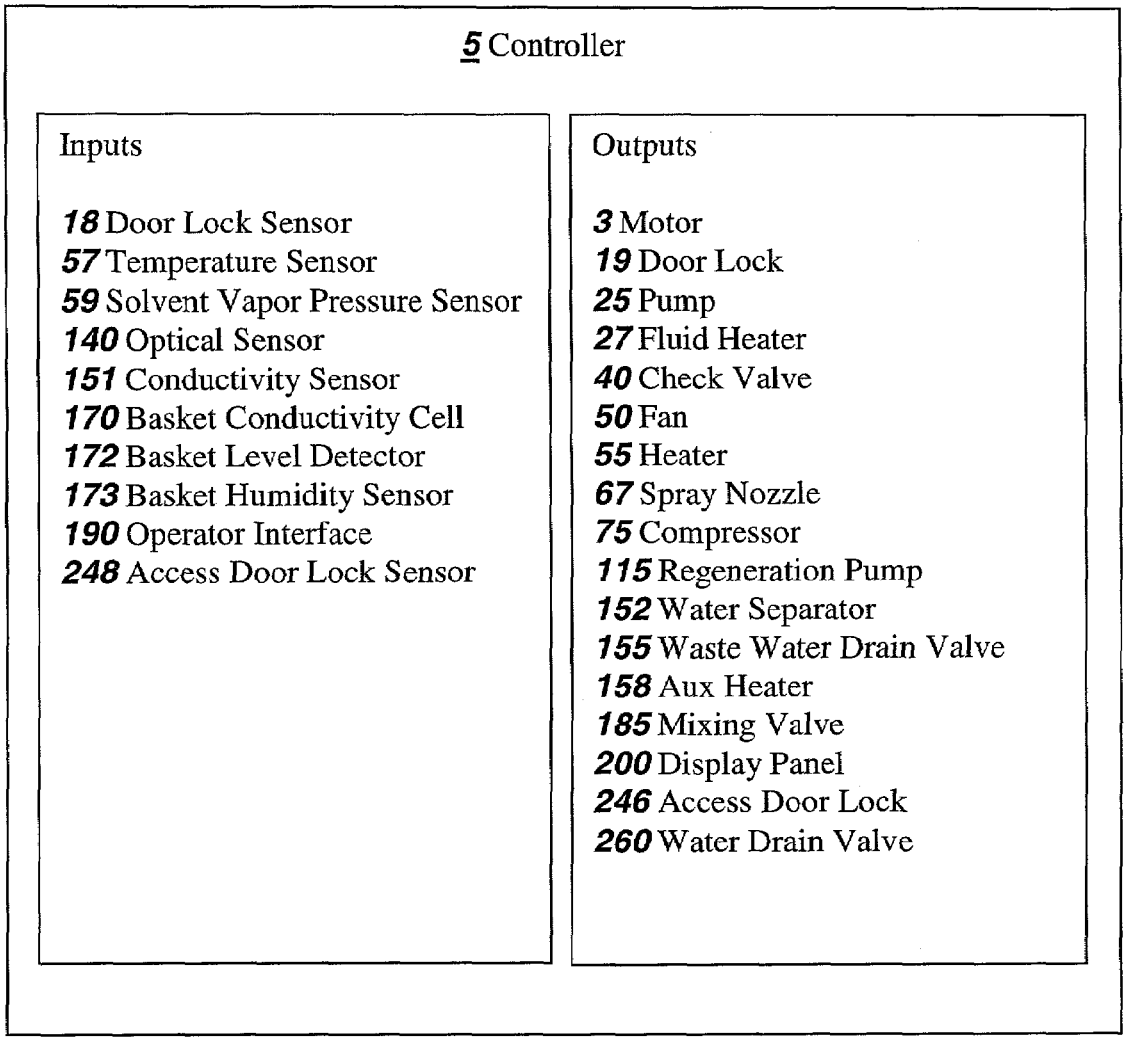
FIG. 7 is a schematic diagram of the devices coupled to the controller in accordance with one embodiment of the present invention.

In one embodiment of the present invention, the controller 5 of FIG. 7 is configured to direct the working fluid 165 of FIG. 2 through to the fluid regeneration device 7 when the conductivity sensor 151 indicates that the working fluid 165 comprises less than about 10% water by weight. The controller 5 of FIG. 7 is further configured to divert the working fluid 165 of FIG. 2 through the waste water drain valve 155 and the waste water discharge piping 154 when the working fluid 165 flowing through the conductivity sensor 151 comprises a minimum of at least about 10% by weight of water to avoid overwhelming the water adsorption capability of the fluid regeneration device 7.

In another embodiment of the present invention, a water separator 152 is disposed in the working tank 45. In another embodiment of the present invention, the water separator 152 is disposed between the waste water drain valve 155 and the fluid regeneration device 7. In another embodiment of the present invention, a bypass line 145 of FIG. 2 is disposed between the discharge of the water separator 152 and the inlet of the clean fluid device 8 to reduce the possibility of overwhelming the water removal capability in the fluid regeneration device 7. In another embodiment of the present invention (not shown in FIG. 2), the bypass line 145 is disposed between the waste water drain valve 155 and the clean fluid device 8. The bypass line 145 is typically sized to bypass a range from about one-quarter to about three-quarter of the total flow of the working fluid 165 around the fluid regeneration device 7.

In one embodiment of the present invention, the water separator 152 is fabricated from materials selected form the group consisting of calcined clay, water adsorbing polymers, sodium sulfate, paper, cotton fiber, lint, and any combination thereof. In another embodiment of the present invention, the water separator 152 comprises a distillination device that utilizes heat to remove water.

The fluid regeneration device 7 comprises a regeneration cartridge 141. The inlet side of the regeneration cartridge 141 is typically coupled to the working fluid device 6. The regeneration cartridge 141 typically comprises at least a water absorption media 130 coupled to a cleaning fluid regeneration absorption media 135. In one embodiment of the present invention, the regeneration cartridge 141 further comprises a mechanical filter 120 and a particulate filter 125. In one embodiment of the present invention, the working fluid 165 passes sequentially through the mechanical filter 120, particulate filter 125, water absorption media 130, and cleaning fluid regeneration absorption media 135. The cleaning fluid regeneration adsorption media 135 contains a portion of the solvent based cleaning fluid 30 in order to replenish the solvent based cleaning fluid 30 that is consumed during the solvent wash/dry process 500 of FIG. 13. The cleaning fluid regeneration adsorption media 135 also contains a replacement amount of solvent based cleaning fluid 30 which is disposed of when changing out the regeneration cartridge 141.

In one embodiment of the present invention, the cleaning fluid regeneration adsorption media 135 is selected from a group consisting of a packed bed column, a flat plate bed, a tortuous path bed, a membrane separator, a column with packed trays, and combinations thereof.

In one embodiment of the present invention, the materials to fabricate the cleaning fluid regeneration adsorption media 135 are selected from the group consisting of activated charcoal, carbon, calcined clay, Kaolinite, adsorption resins, carbonaceous type resins, silica gels, alumina in acid form, alumina in base form, alumina in neutral form, zeolites, molecular sieves, and any combination thereof. Both the amount of solvent based cleaning fluid regeneration and the speed of solvent based cleaning fluid regeneration depend on the volume of the cleaning fluid regeneration adsorption media 135.

In one embodiment of the present invention, the regeneration cartridge 141 containing the cleaning fluid regeneration adsorption media 135 in the packed bed column form is disposed in a single packed bed column cartridge form. In another embodiment of the present invention, the regeneration cartridge 141 comprising the cleaning fluid regeneration adsorption media 135 in the packed bed column form is disposed in a plurality of packed bed column cartridges. In an alternative embodiment of the present invention, the regeneration cartridge 141 comprises the cleaning fluid regeneration adsorption media 135 in a plurality of packed bed column cartridges, which are disposed in series with respect to one another. In yet another embodiment of the present invention, the regeneration cartridge 141 further comprises the cleaning fluid regeneration adsorption media 135 in the plurality of packed bed column cartridges, which are disposed in parallel with respect to one another.

Figure 3:
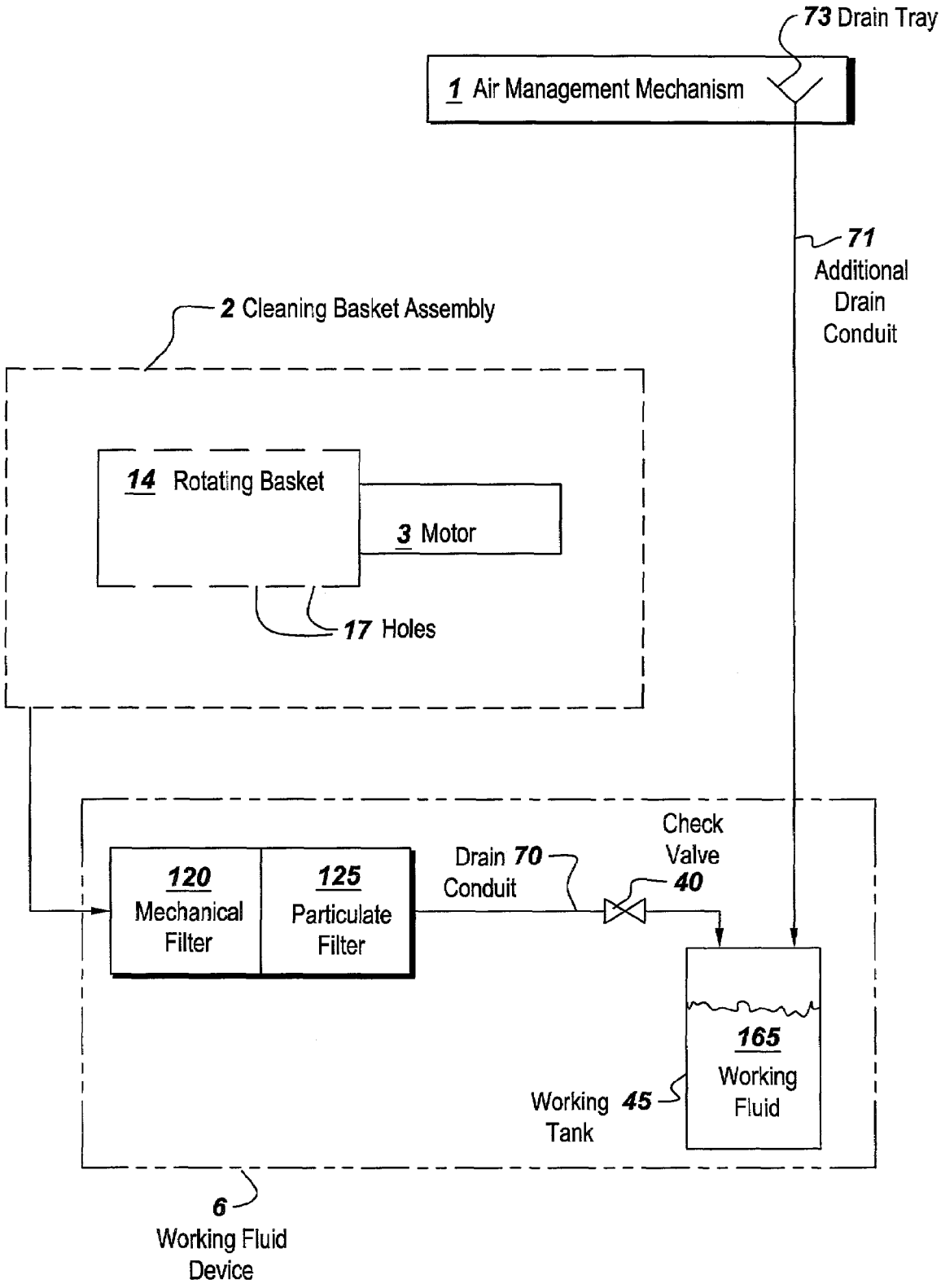
FIG. 3 is a schematic diagram of a filter arrangement in accordance with one embodiment of the present invention.

In another embodiment of the present invention, the mechanical filter 120 of FIG. 3 and the particulate filter 125 are part of the working fluid device 6. The mechanical filter 120 and the particulate filter 125 are disposed in the drain conduit line 70 that couples the cleaning basket assembly 2 to the working tank 45. The mechanical filter 120 and the particulate filter 125 are disposed in the drain conduit 70 between the cleaning basket assembly 2 and the check valve 40.

Figure 4:
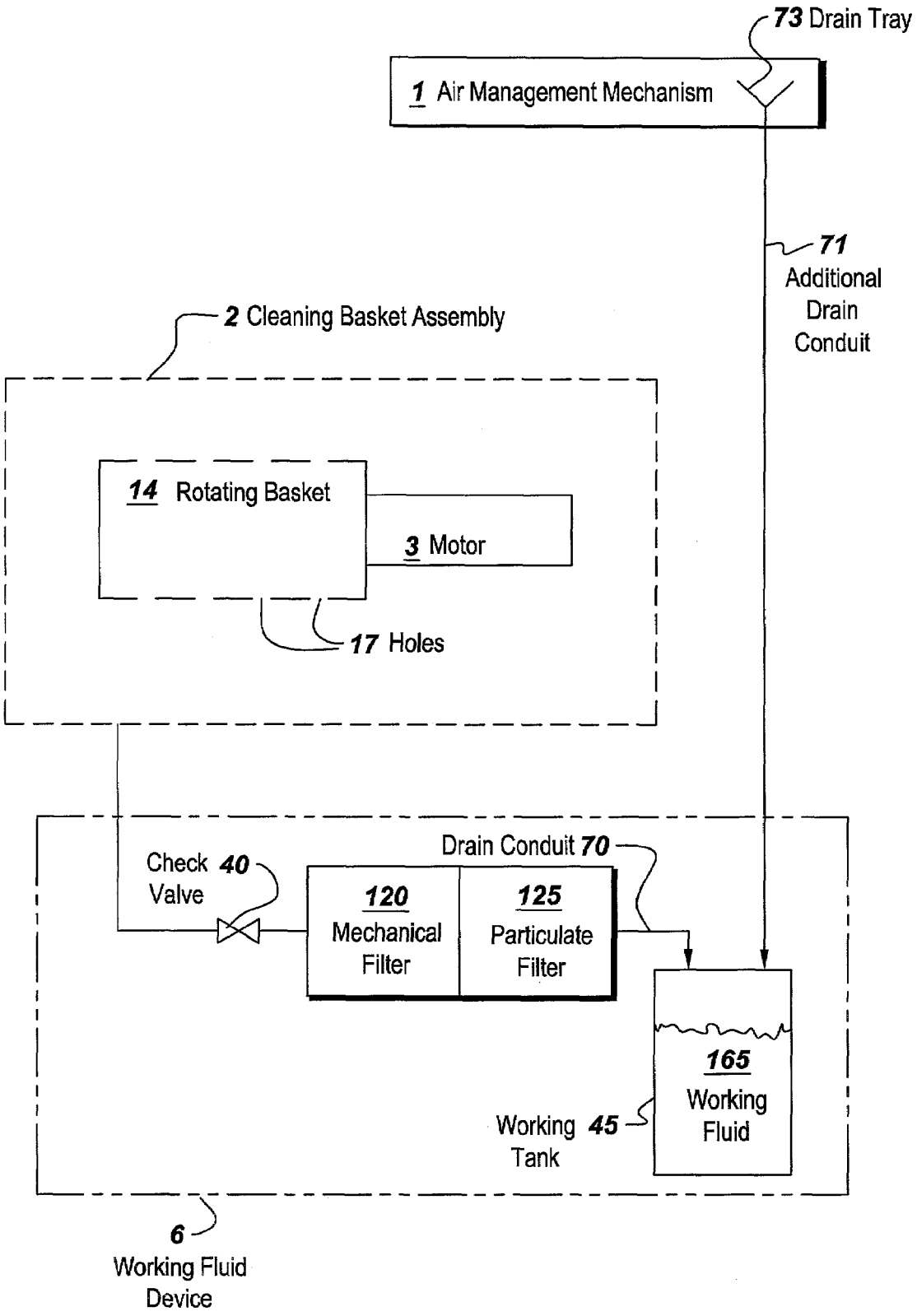
FIG. 4 is a schematic diagram of a filter arrangement in accordance with another embodiment of the present invention.

In another embodiment of the present invention, the mechanical filter 120 of FIG. 4 and the particulate filter 125 are disposed in the drain conduit 70 between the check valve 40 and the working tank 45. In an alternative embodiment of the present invention, the mechanical filter 120 is disposed in the drain conduit 70, while the particulate filter 125 is disposed in the regeneration cartridge 141. In another embodiment of the present invention, the mechanical filter 120 is not present and the particulate filter 125 is disposed in the regeneration cartridge filter 141. In another embodiment of the present invention, the mechanical filter 120 is not present and the particulate filter 125 is disposed in the drain conduit 141. Both the arrangement of the internals of the regeneration cartridge 141 and the location and application of the mechanical filter 120 and the particulate filter 125 are provided for illustrative purposes and are not intended to imply a restriction on the present invention.

In one embodiment of the present invention, mechanical filter 120 has a mesh size in a range from about 50 microns to about 1000 microns. In one embodiment of the present invention, the particulate filter 125 has a mesh size in a range from about 0.5 microns to about 50 microns.

In one embodiment of the present invention, the particulate filter 125 is a cartridge filter fabricated from materials selected from the group consisting of thermoplastics, polyethylene, polypropylene, polyester, aluminum, stainless steel, metallic mesh, sintered metal, ceramic, membrane diatomaceous earth, and any combination thereof.

Figure 9:
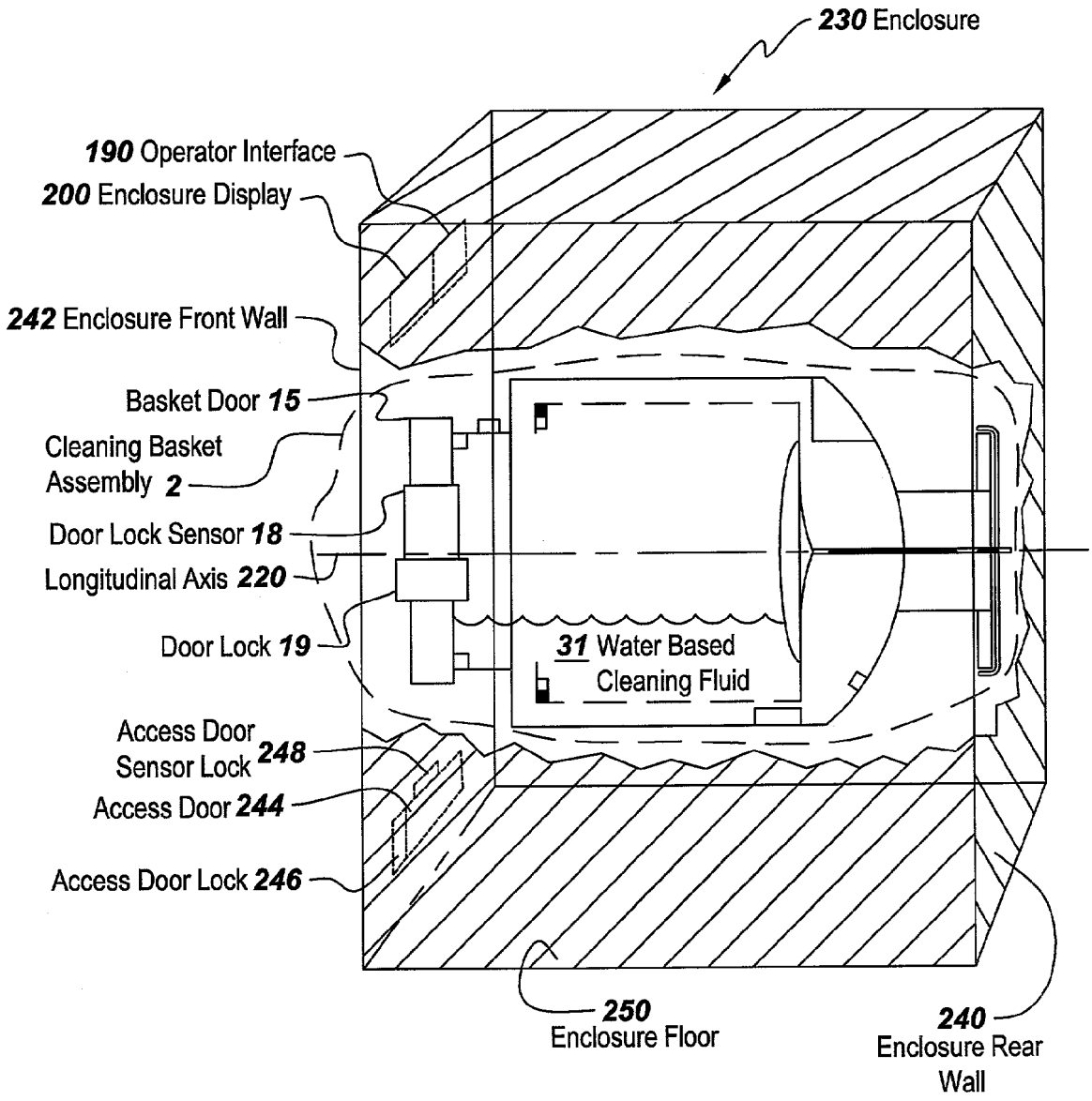
FIG. 9 is a three-dimensional partial cross sectional view of the article cleaning apparatus in accordance with one embodiment of the present invention.

After the working fluid 165 passes through the regeneration cartridge 141, it exits the regeneration cartridge 141 as the solvent based cleaning fluid 30. An outlet side of the regeneration cartridge 141 is typically coupled to an optical turbidity sensor 140. The optical turbidity sensor 140 is typically coupled to a storage tank 35 in the clean fluid device 8. The optical turbidity sensor 140 is tuned to a specific absorbance level that provides information about the cleanliness of the solvent based cleaning fluid 30. When the solvent based cleaning fluid 30 exiting the optical turbidity sensor 140 reaches a preset specific absorbance level, the controller 5 of FIG. 7 sends a "replace regeneration cartridge" message to the operator on a display panel 200 (FIG. 9).

The storage tank 35 of FIG. 2 in the clean fluid device 8 stores the solvent based cleaning fluid 30 received from the fluid regeneration device 7. The clean fluid device 8 further comprises a pump 25 that is coupled to the storage tank 35. The pump 25 is coupled to the cleaning basket assembly 2 via an inlet line 26. In one embodiment of the present invention, the pump 25 is also typically coupled to the air management mechanism 1 via cooling coil wash down tubing 160. In another embodiment of the present invention, the clean fluid device 8 further comprises a spray nozzle 67 that is typically disposed in the cooling coil wash down tubing 160 to control the flow of the solvent based cleaning fluid 30 to the air management mechanism 1. As used herein, the term, "spray nozzle" is defined to be a nozzle, an orifice, a spray valve, a pressure reducing tubing section, and any combination thereof. In one embodiment of the present invention, the spray nozzle 67 is coupled to the controller 5 as is shown in FIG. 7 when the spray nozzle 67 is a spray valve.

Figure 5:
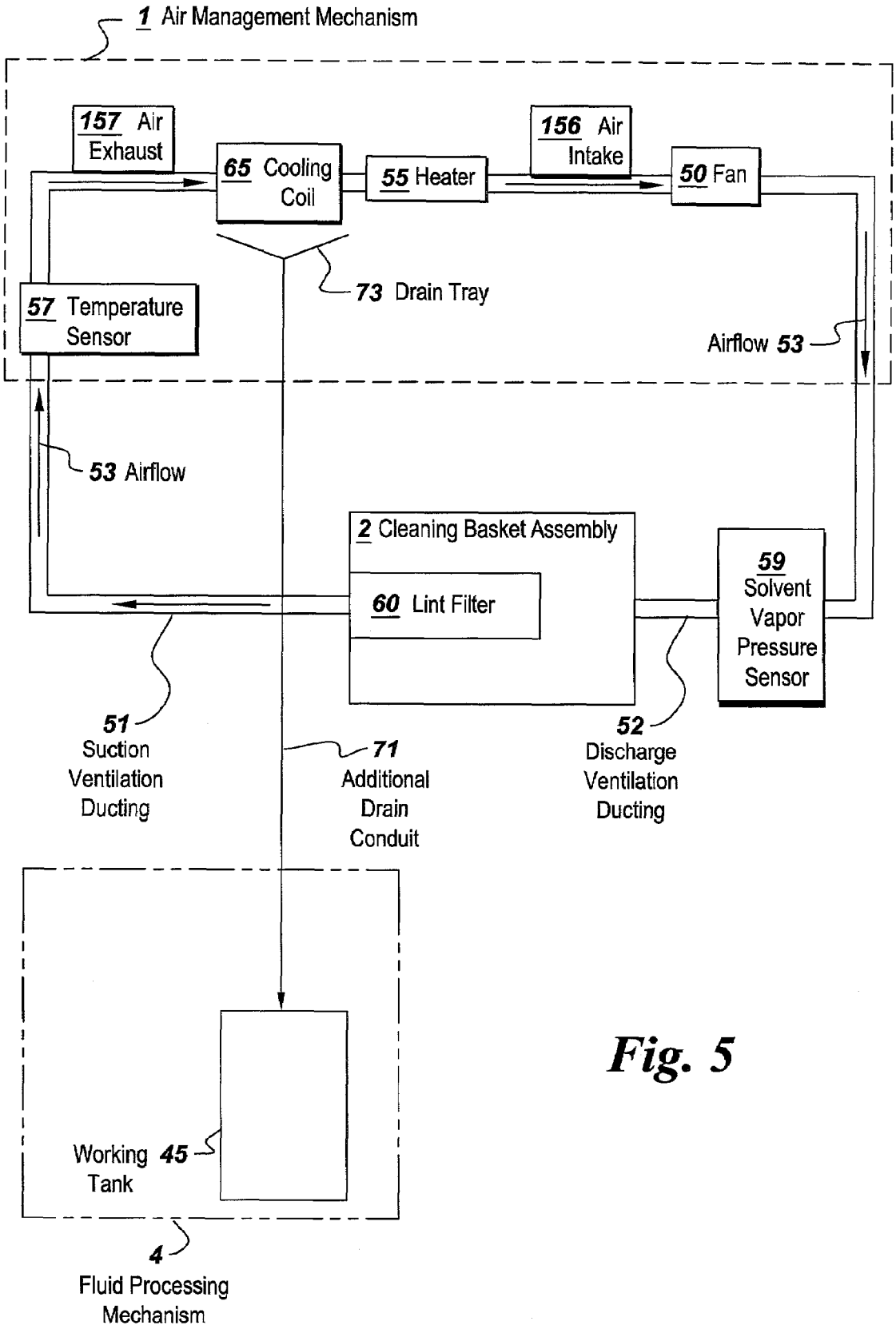
FIG. 5 is a schematic diagram of the air management mechanism and the cleaning basket assembly in accordance with one embodiment of the present invention.

The air management mechanism 1 of FIG. 5 comprises a cooling coil 65, a heater 55, and a fan 50. The air management mechanism 1 is coupled to the cleaning basket assembly 2 by suction ventilation ducting 51 and discharge ventilation ducting 52. The fan 50 is disposed to provide airflow 53 through the cooling coil 65, the heater 55, the discharge ventilation ducting 52, the cleaning basket assembly 2, and the suction ventilation ducting 51. A temperature sensor 57 is also typically disposed in the airflow 53. The temperature sensor 57 is typically disposed in the suction ventilation ducting 51, the discharge ventilation ducting 52, the cleaning basket assembly 2, and any combination thereof.

The cooling coil 65 is configured to have a cooling medium disposed to flow across one side of a heat transfer surface of the cooling coil 65, while the airflow 53 passes across the opposite side of the heat transfer surface of the cooling coil 65. The heat transfer surface of the cooling coil 65 separates the cooling medium and the airflow 53. The inlet temperature of the cooling medium utilized is typically cooler that the temperature of the airflow 53 in order to condense vapors in the airflow 53. As used herein, the term, "cooling medium" is defined, for illustrative purposes and without limitation, as being selected from water, refrigerants, air, other gasses, ethylene glycol/water mixtures, propylene glycol/water mixtures and any combination thereof. The drain tray 73 is disposed under the cooling coil 65 and is coupled to the working tank 45 as described above.

In one embodiment of the present invention, the air management mechanism 1 typically further comprises an air intake 156 and an air exhaust 157. The air intake 156 and air exhaust 157 are disposed to provide air exchange between the airflow 53 and the air that is outside of the air management mechanism 1 to promote the drying of articles that have been subjected to the water cleaning process 600 of FIG. 14. The air intake 156 and air exhaust 157 are disposed in a similar configuration to that of a conventional dryer. In one embodiment of the present invention, the air intake 156 of FIG. 5 is disposed in the ventilation path between the heater 55 and the fan 50, while the air exhaust 157 is disposed between the cooling coil 65 and the cleaning basket assembly 2. The locations of the air intake 156 and air exhaust 157 are provided for illustration and in no way implies a restriction to the present invention.

Figure 6:
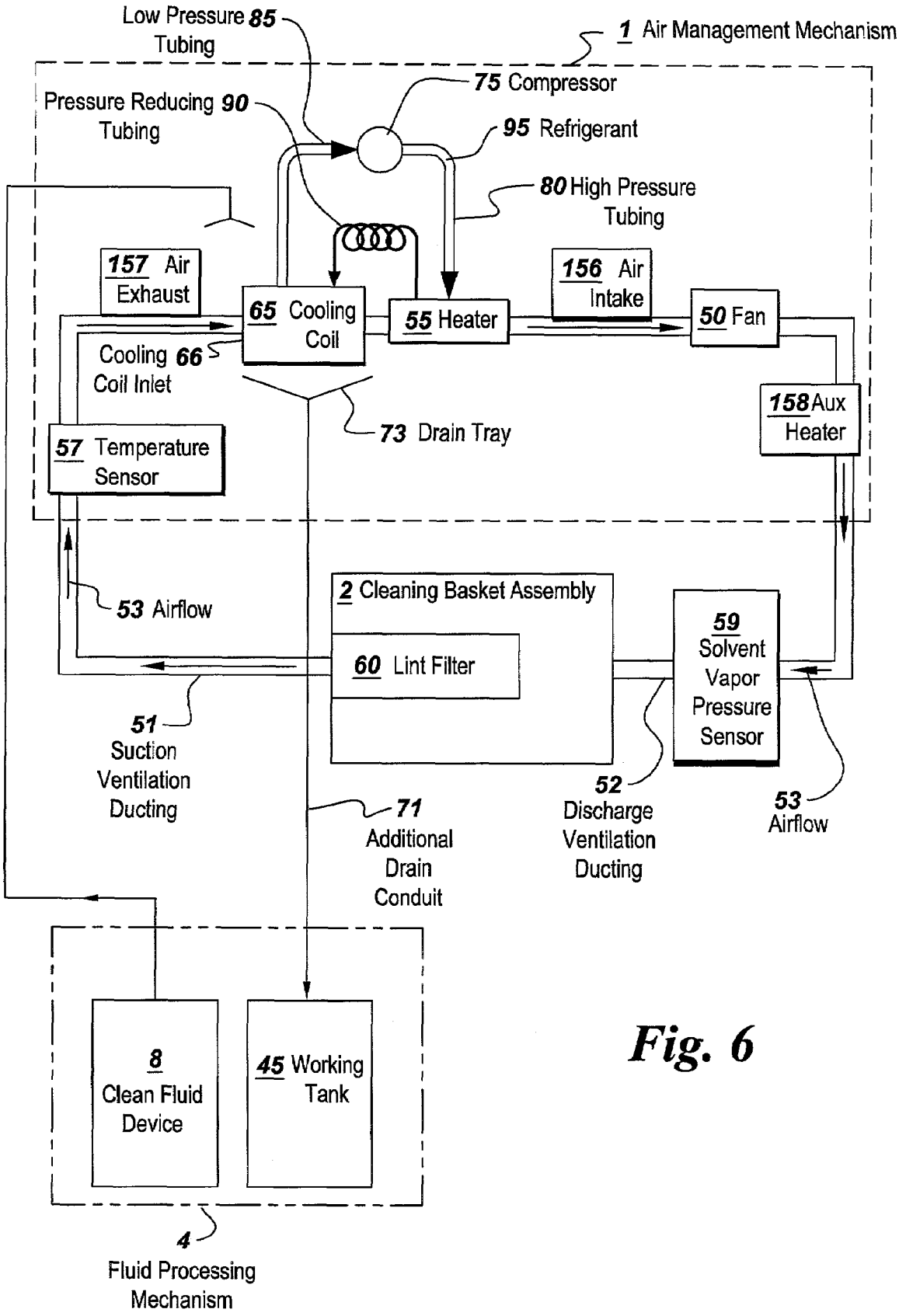
FIG. 6 is a schematic diagram of the air management mechanism and the cleaning basket assembly in accordance with another embodiment of the present invention.

A solvent vapor pressure sensor 59 detects the vapor pressure of the solvent based cleaning fluid 30 in the airflow 53 that circulates between the cleaning basket assembly 2 and the air management mechanism 1. The solvent vapor pressure sensor 59 is used to determine when solvent vapor pressure level reaches a predetermined level that indicates that the airflow 53 is no longer entraining substantial amounts of the solvent based cleaning fluid 30 of FIG. 2. The solvent vapor pressure sensor 59 of FIG. 6 is disposed in the discharge ventilation ducting 52. In another embodiment of the present invention, the solvent vapor pressure sensor 59 is typically disposed in the suction ventilation ducting 51, the discharge ventilation ducting 52, the cleaning basket assembly 2, and any combination thereof. In one embodiment of the present invention, the solvent vapor pressure sensor 59 replaces the temperature sensor 57.

The cooling coil 65 of FIG. 6 further comprises a cooling coil air inlet 66. In one embodiment of the present invention, one end of the cooling coil wash down tubing 160 is aimed at the cooling coil air inlet 66 of FIG. 6. The spray nozzle 67 and the pump 25 flushes away lint and debris that accumulates on the surface of the cooling coil air inlet 66 of FIG. 6 to maintain airflow 53 (i.e. decrease the pressure drop across the cooling coil 65) through the air management mechanism 1 and the cleaning basket assembly 2. In one embodiment of the present invention, spraying the solvent based cleaning fluid 30 of FIG. 2 at the cooling inlet 66 of FIG. 6 provides additional cooling and condensation of vapor in the airflow 53.

As shown in FIG. 6, in another embodiment of the present invention, the air management mechanism 1 further comprises a compressor 75, high-pressure tubing 80, low-pressure tubing 85 and pressure reducing tubing 90 are disposed in a vapor compression cycle. As used herein, the term, "high-pressure tubing" is used to indicate that the high-pressure tubing is designed to contain a refrigerant 95 at a higher pressure than the "low-pressure tubing". The use of the terms "high-pressure tubing" and "low-pressure tubing" are used to express a relative pressure differential across the compressor 75. As used herein, the term, "pressure reducing tubing" is defined to indicate that the "pressure reducing tubing" comprises a flow restriction that is sufficient to provide the relative pressure differential at a junction between the "high-pressure tubing" and the "low-pressure tubing". The high-pressure tubing 80 of FIG. 6 is disposed from the compressor 75 to the heater 55. The pressure reducing tubing 90 is disposed between the heater 55 and the cooling coil 65. The low-pressure tubing 85 is disposed from the compressor 75 to the cooling coil 65. The refrigerant 95 is disposed to flow between the compressor 75, heater 55, and cooling coil 65.

Figure 13:
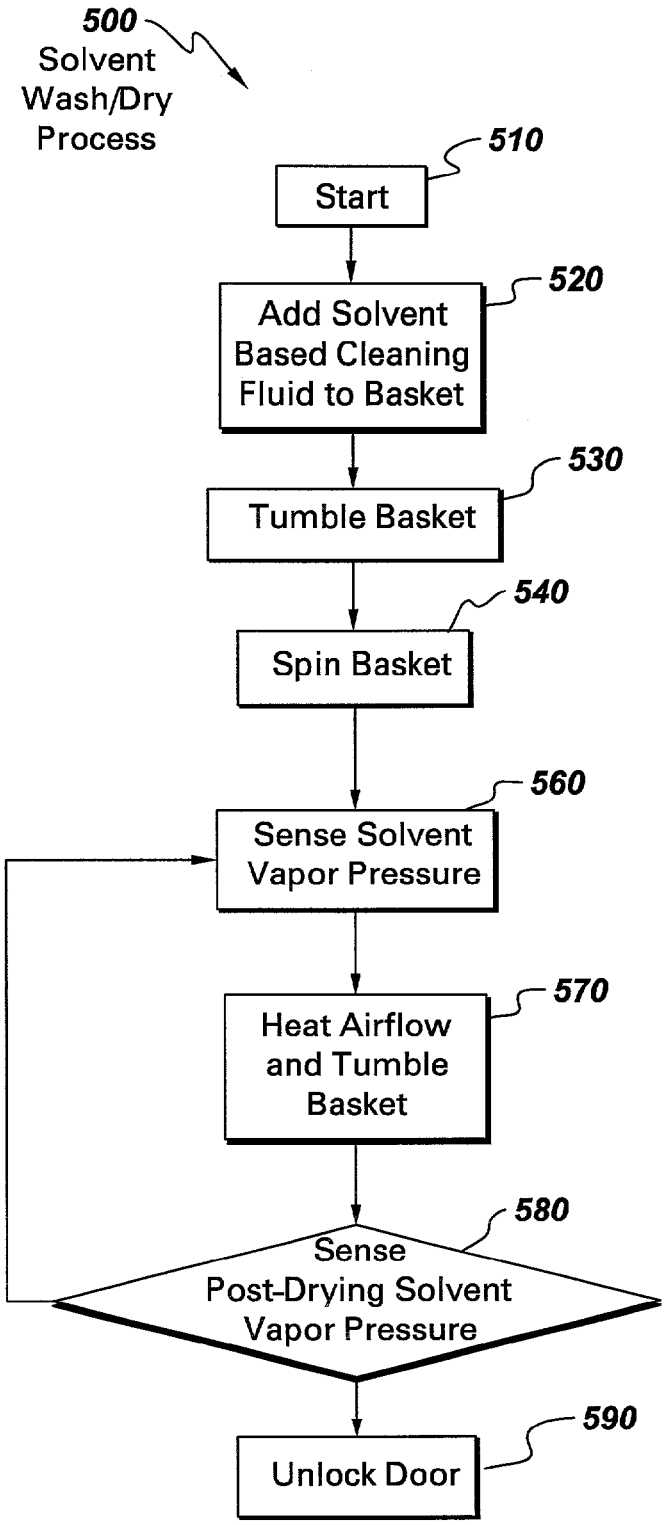
FIG. 13 is a flow diagram of a solvent cleaning process in accordance with one embodiment of the present invention.

The vapor compression cycle attains a higher coefficient of performance (COP) for solvent wash/dry process 500 of FIG. 13. The vapor compression cycle operating in a heat pump configuration reduces energy requirements for the solvent cleaning process 375 of FIG. 11. Energy is conserved as the refrigerant 95 of FIG. 6 passing through the cooling coil 65 absorbs heat from the airflow 53 and then the refrigerant 95 rejects the heat back into the airflow 53 by passing through the heater 55. In one embodiment of the present invention, the refrigerant 95 is fluorocarbon R-22; however, other refrigerants known to one skilled in the refrigerant art would be acceptable. The heater 55 functions as a condenser (warming the air flow 53 through the heater 55), while the cooling coil 65 functions as an evaporator (cooling the air flow 53 through the cooling coil 65 and condensing any vapor).

In another embodiment of the present invention, the air management mechanism 1 further comprises an auxiliary heater 158 of FIG. 6. The fan 50 is further disposed to provide airflow 53 through the auxiliary heater 158. Typically, the auxiliary heater 158, used in conjunction with the heater 55, provides a higher temperature in the airflow 53 that enters the cleaning basket assembly 2. The auxiliary heater 158 is disposed in the discharge ventilation ducting 52. In another embodiment of present invention, the auxiliary heater 158 is disposed in the suction discharge ventilation ducting 53. Raising the air temperature of the airflow 53 typically decreases the drying time for the articles in the humidity sensing process 400 of FIG. 12 and the solvent wash/dry process 500 of FIG. 13.

The inputs to the controller 5 of FIG. 7 are typically selected from the group consisting of the door lock sensor 18, the temperature sensor 57, the solvent vapor pressure sensor 59, the optical sensor 140, the conductivity sensor 151, the basket conductivity cell 170, the basket level detector 172, the basket humidity sensor 173, the operator interface 190, the access door lock sensor 248, and any combination thereof. The outputs of the controller 5 are typically selected from the group consisting of the motor 3, the door lock 19, the pump 25, the fluid heater 28, the check valve 40, the fan 50, the heater 55, the spray nozzle 67, the compressor 75, the regeneration pump 115, the water separator 152, the waste water drain valve 155, the auxiliary heater 158, the mixing valve 185, the display panel 200, the access door lock 246, the water drain valve 260, and any combination thereof.

The controller 5 is further configured to perform a solvent based cleaning fluid recirculation process. In the solvent based cleaning fluid recirculation process, the solvent based cleaning fluid 30 passes through the fluid processing mechanism 4 and cleaning basket assembly 4 as discussed above for a predetermined amount of time. The solvent based cleaning fluid recirculation process is performed when the article cleaning apparatus 1000 is not engaged in either the cleaning process 350 of FIG. 11 or the drying process 360. In the case where the operator selects either the cleaning process 350 or the drying process 360 during the solvent based cleaning fluid recirculation process, the controller 5 recovers the article cleaning apparatus 1000 using a cycle interruption recovery process 800 of FIG. 16, which will be subsequently described in detail. As used herein, the term, "recovers the article cleaning apparatus," relates to placing the article cleaning apparatus 1000 in a condition to perform either the cleaning process 350 or the drying process 360.

Figure 8:
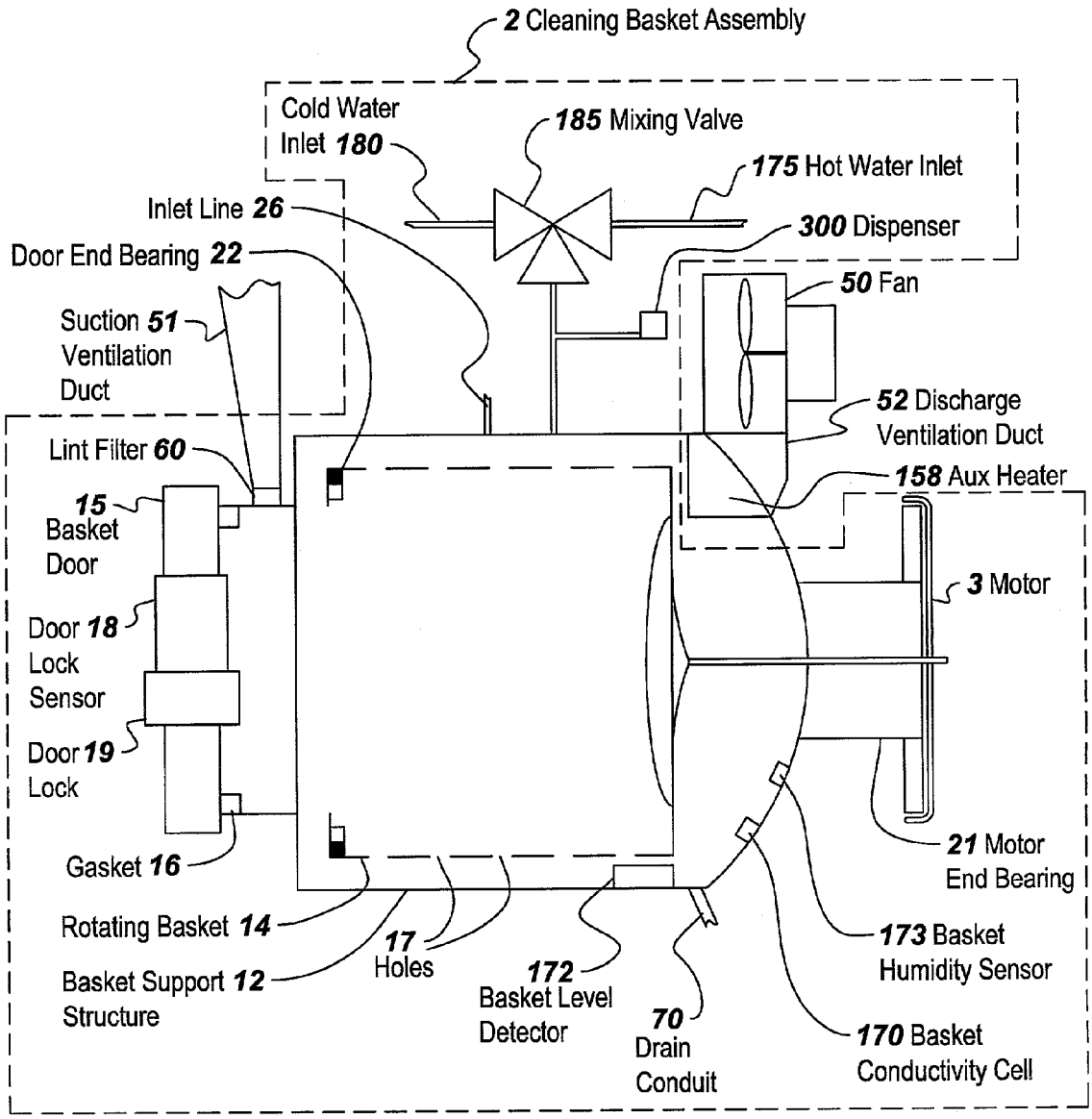
FIG. 8 is a schematic cross sectional view of the cleaning basket assembly in accordance with one embodiment of the present invention.

The cleaning basket assembly 2 of FIG. 8 depicts one embodiment of the present invention where a cleaning basket support structure 12 supports the rotating basket 14 through a door end bearing 22 and a motor end bearing 21. The motor 3 is disposed to the rotating basket 14 at the opposite end of the rotating basket where a basket door 15 is disposed. The cleaning basket assembly 2 further comprises a gasket 16, a door lock sensor 18, and a door lock 19. The basket support structure 12 further comprises a liquid drain connection to the drain conduit 70 and a solvent based cleaning fluid supply connection to the inlet tubing 26. The basket support structure 12 further comprises a connection to the discharge ventilation ducting 52 and a connection to the suction ventilation ducting 51. A lint filter 60 is typically situated in the suction ventilation ducting 51. The cleaning basket assembly 2 of FIG. 8 further comprises a basket humidity sensor 173 that has the capability to determine the humidity level in the rotating basket 14. In one embodiment of the present invention, the basket humidity sensor 173 is disposed inside the basket support structure 12 adjacent the rotating basket 14.

The air management mechanism 1 of FIG. 1, the cleaning basket assembly 2, fluid processing mechanism 4, and the controller 5 are disposed inside an enclosure 230 of FIG. 9, where only the cleaning basket assembly 2 is depicted in the cut away view of the enclosure 230. Additionally, the controller 5 of FIG. 7 is configured to receive input controls from the operator from an operator interface 190 of FIG. 9 and configured to provide a cleaning status at the display panel 200. The enclosure 230 further comprises an enclosure floor 250 that is substantially perpendicular to an enclosure rear wall 240. The rotating basket 14 has a longitudinal axis 220 that is about parallel to the enclosure floor 250. As used herein, the term, "about parallel" is defined to include a range from about −3 degrees to about +3degrees from parallel. The enclosure 230 further comprises an enclosure front wall 242 that is on the side of the enclosure where the basket door 15 is disposed. In one embodiment of the present invention, the operator interface 190 and the display panel 200 are disposed on the enclosure front wall 242. The location of the operator interface 190 and the display panel 200 is provided by way of illustration and is not intended to imply a limitation to the present invention. In one embodiment of the present invention, the enclosure floor 250 is configured to act as a containment pan to collect leakage of the solvent based cleaning fluid 30. In another embodiment of the present invention, the enclosure 230 is configured to act as the containment pan to collect leakage of the solvent based cleaning fluid 30.

In one embodiment of the present invention, the enclosure 230 has an overall volumetric shape of about 0.7 meters in width, by about 0.9 meters in depth, by about 1.4 meters in height. This volumetric shape represents the typical space available in an in-home laundry setting.

The regeneration cartridge 141 of FIG. 2 is typically the one item in the fluid processing mechanism 4 requiring periodic replacement. In one embodiment of the present invention, the enclosure front wall 242 of FIG. 9 comprises an access door 244, an access door lock 246, and an access door lock sensor 248. The location of the access door 244, access door lock 246 and the access door lock sensor 248 is provided by way of illustration and is not intended to imply a limitation to the present invention. The access door lock 246 and access door lock sensor 248 are coupled to the controller 5 of FIG. 7. The controller logic in the controller 5 keeps the access door lock 246 locked during the cleaning process 350 of FIG. 11, the drying process 360, and the solvent based cleaning fluid recirculation process. The controller logic only permits replacing the regeneration cartridge 141 of FIG. 2 when the article cleaning apparatus 1000 is not operating any of the following: the cleaning process 350 of FIG. 11, the drying process 360 and the solvent based cleaning fluid recirculation process. When the controller logic verifies that any of the following: the cleaning process 350 of FIG. 11, the drying process 360, and the solvent based cleaning fluid recirculation process are not in progress, then the controller 5 of FIG. 7 unlocks the access door lock 246 in response to an operator request via the operator interface 190 to replace the regeneration cartridge 141. If an operator requests to replace the regeneration cartridge 141 and the article cleaning apparatus 1000 is operating any process, the operator is notified that the replacement of the regeneration cartridge 141 is not permitted via a notification message displayed on the display panel 200. By not permitting the cleaning process 350 of FIG. 11, the drying process 360, and the solvent based cleaning fluid recirculation process to be performed by the article cleaning apparatus 1000 of FIG. 2 during the regeneration cartridge 141 replacement, the operator is afforded protection from an inadvertent exposure to the solvent based cleaning fluid 30. Additionally, the controller logic does not allow the article cleaning apparatus 1000 to initiate any process until the access door lock sensor 248 of FIG. 9 verifies that the access door 244 is shut and the access door lock 246 is locked. The access door lock sensor 248 is additionally configured to detect that the regeneration cartridge 141 of FIG. 2 is properly installed before indicating that the access door 244 of FIG. 9 is properly closed and that the access door lock 246 is properly locked.

Additionally, in one embodiment of the present invention, the regeneration cartridge 141 of FIG. 2 further comprises a leak proof double inlet valves assembly 101 and a leak proof double outlet valves assembly 106 to minimize the operator's contact with the solvent based cleaning fluid 30. In another embodiment of the present invention, the regeneration cartridge 141 (not shown in FIG. 2) further comprises a leak proof single inlet valve assembly 100 and a leak proof single outlet valve assembly 105 to minimize the operator's contact with the solvent based cleaning fluid 30. As used herein, the term, "leak proof" is defined to mean that there is no leakage of the solvent based cleaning fluid 30 beyond about 1 ml evident at 1) either end of the regeneration cartridge 141 after removal and 2) the connection points where the regeneration cartridge 141 installs into the fluid regeneration device 7.

The controller logic in the controller 5 of FIG. 7 is designed to keep the basket door lock 19 locked shut while performing any of the following: the cleaning process 350, the drying process 360, and the solvent based cleaning fluid recirculation process. This limits the operator's ability to expose oneself to the solvent based cleaning fluid 30 during any of the following: the cleaning process 350, the drying process 360, and the solvent based cleaning fluid recirculation process thereby reducing the number of opportunities that the operator is exposed to the solvent based cleaning fluid 30.

In one embodiment of the present invention, the clean fluid device 8 of FIG. 2 further comprises a fluid heater 27 disposed between the pump 25 and the cleaning basket assembly 2 in the inlet line 26. The fluid heater 27 is coupled to the controller 5 of FIG. 7. The fluid heater 27 has the ability to increase the temperature of the solvent based cleaning fluid 30. The elevated temperature of the solvent based cleaning fluid 30 has the effect of improving the soil removal cleaning performance for some types of article and soiling combinations.

In another embodiment of the present invention the article cleaning apparatus 1000 of FIG. 1 is further configured to add a small quantity of water (in the range from about 1 percent to about 8 percent of the total weight of the solvent based cleaning fluid 30) and other cleaning agents to the rotating basket 14 to mix with the solvent based cleaning fluid 30 entering the cleaning basket assembly 2 through the inlet line 26. In one embodiment of the present invention, the cleaning basket assembly 2 of FIG. 8 further comprises a hot water inlet 175 and a cold-water inlet 180, both of which are coupled to a mixing valve 185. A basket conductivity cell 170 and a basket level detector 172 are disposed in the cleaning basket assembly 2, such that the basket conductivity cell 170 determines the conductivity of the fluid in the rotating basket 14 and the basket level detector 172 determines the level of the water based cleaning fluid 31 or the solvent based cleaning fluid 30 in the rotating basket 14. In one embodiment of the present invention, a dispenser 300 is disposed off a line that couples the mixing valve 185 to the basket support structure 12. Additionally, the operator adds the cleaning agents to the dispenser 300 and the subsequent action of the water running through the line coupling the mixing valve 185 to the basket support structure 12 entrains the cleaning agents that are disposed in the dispenser 300 into the water entering the rotating basket 14.

Figure 14:
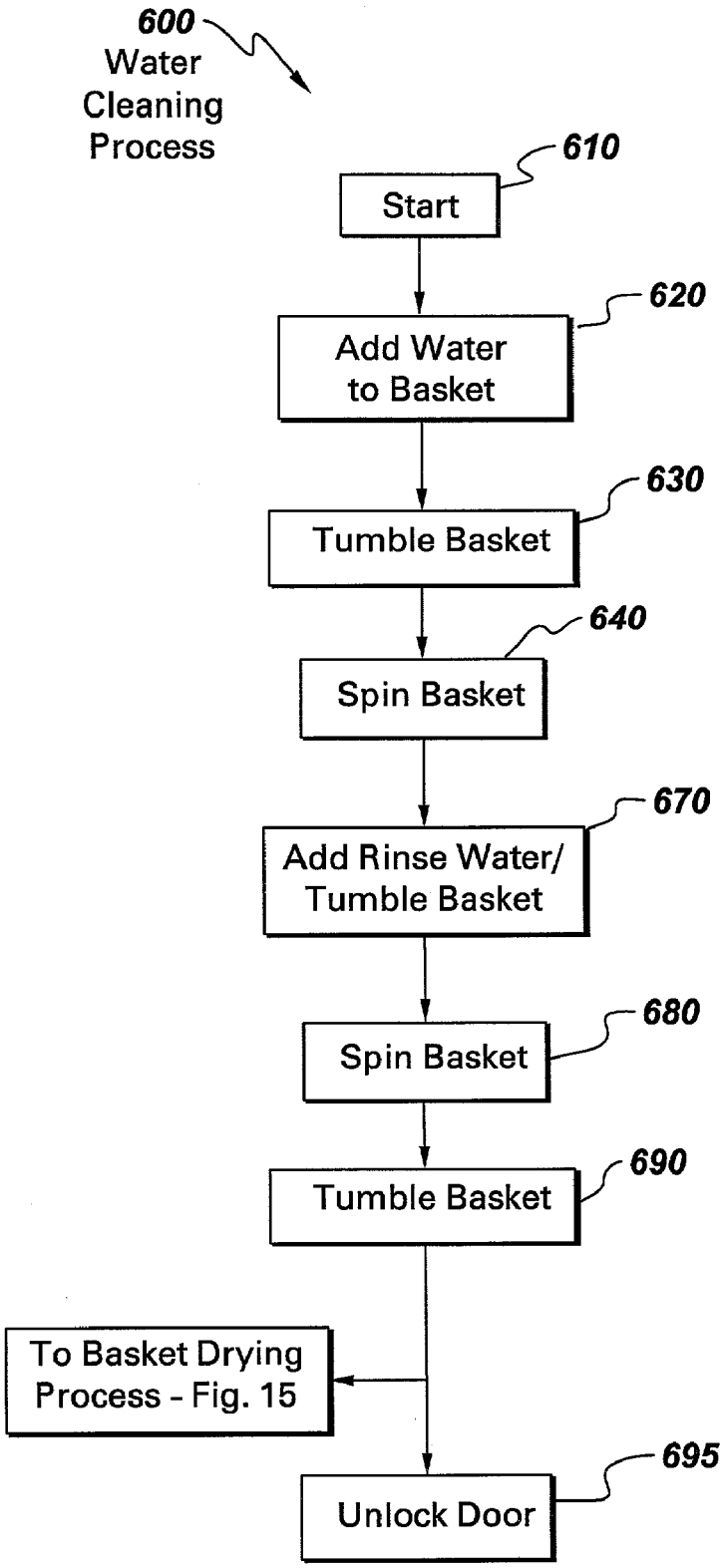
FIG. 14 is a flow diagram of a water cleaning process in accordance with one embodiment of the present invention.

In one embodiment of the present invention, the article cleaning apparatus 1000 of FIG. 1 is further configured to perform the water cleaning process 600 of FIG. 14 utilizing a water based cleaning fluid 31. In addition to the above-discussed components associated with monitoring and adding water to the rotating basket 14, a water drain line 270 connects to the drain conduit 70 upstream of the check valve 40. The water drain line 270 also connects to the suction side of the regeneration pump 115. A water drain valve 260 is disposed in the water drain line 270. The method of adding cleaning agents to the water in the rotating basket 14 is the same as discussed above.

Figure 10:
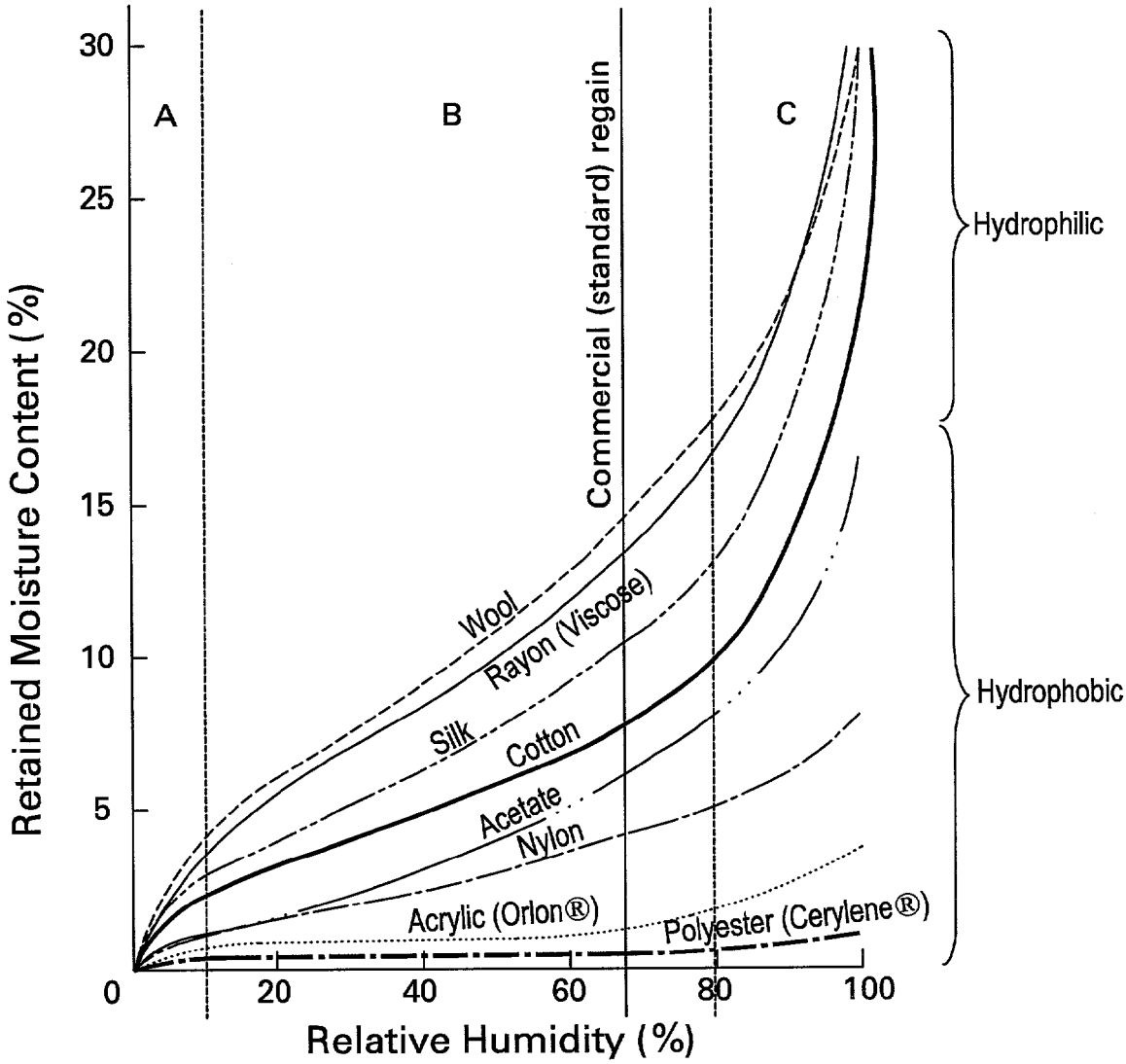
FIG. 10 is a plot of retained moisture content as a percentage of an article's weight versus the relative humidity.

A plot of retained moisture content as a percentage of an article's weight versus the relative humidity is provided in FIG. 10 for a variety of materials that are commonly used to comprise articles. As the fluid processing mechanism 4 of FIG. 2 contains a finite quantity of water removal capability, the controller 5 of FIG. 7 is configured to reduce the amount of water admitted to the fluid processing mechanism 4 of FIG. 2. The reduction of the retained moisture content is accomplished in a humidity sensing process 400 of FIG. 11 that is part of the solvent cleaning process 375.

Figure 11:
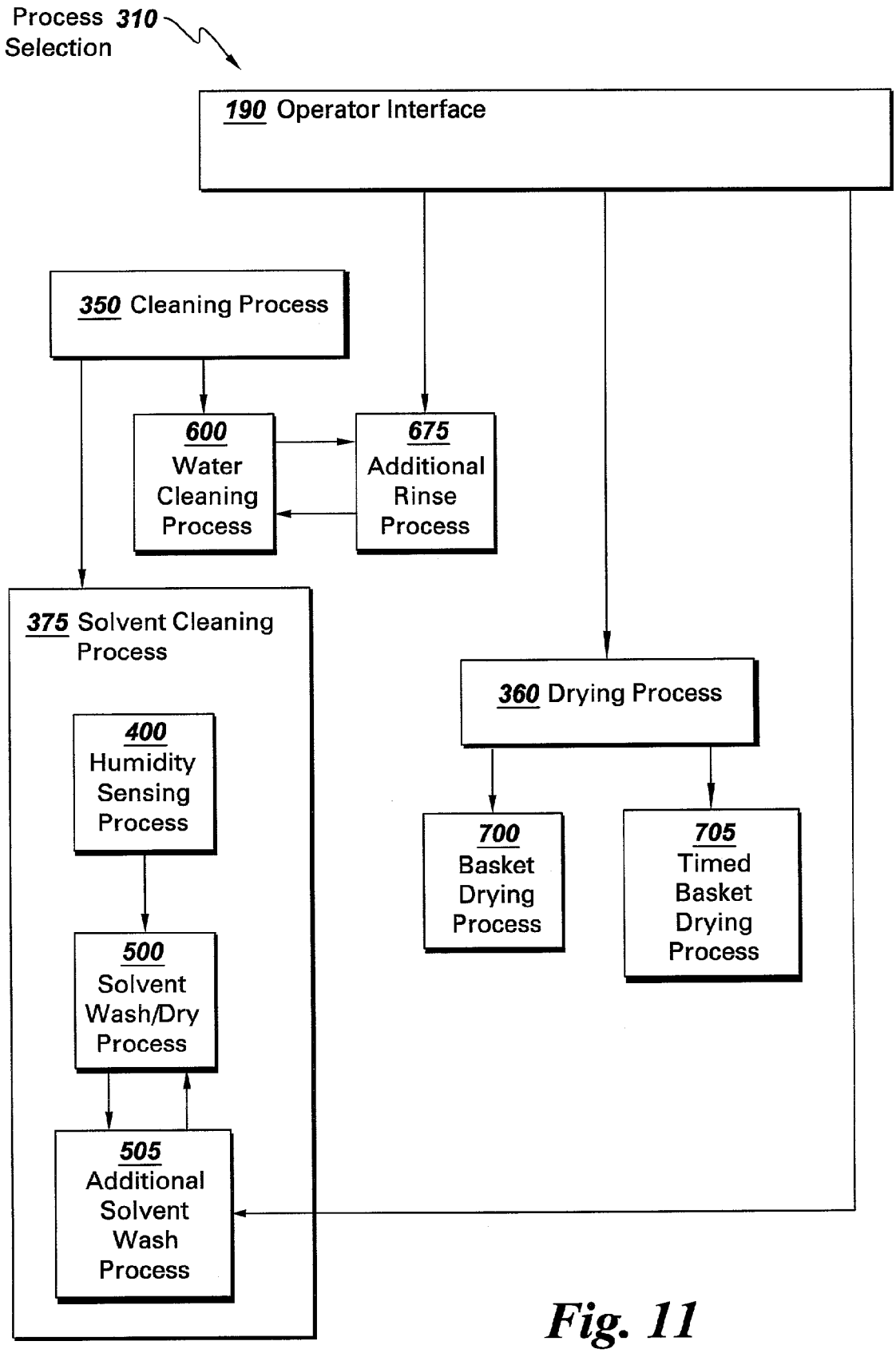
FIG. 11 is a block diagram of the process selection in accordance with one embodiment of the present invention.

In one embodiment of the present invention, a process selection 310 of FIG. 11 occurs at the operator interface 190 and provides inputs to the controller 5 of FIG. 7. The operator selects between the cleaning process 350 of FIG. 11 and a drying process 360. As used herein, the term, "drying process" refers to the drying of articles after completing the water based cleaning 600 of FIG. 14. When the operator selects the cleaning process 350 of FIG. 11, the operator then further chooses between performing either the solvent cleaning process 375 or the water cleaning process 600. In the present invention, the solvent cleaning process 375 of FIG. 11 is defined to include performing the humidity sensing process 400 and the subsequent solvent wash/dry process 500. Conversely, when the operator selects the drying process 360, a basket drying process 700 is performed. In one embodiment of the present invention, the operator has the option to select an additional solvent wash process as part of the solvent wash/dry process 500. The additional solvent wash process is typically used in conjunction with utilizing the solvent based cleaning fluid 30 that comprises cleaning agents. The additional solvent wash process typically improves the removal of the cleaning agents from the articles that remain after initially completing step 540 as detailed below. In another embodiment of the present invention, the operator has the option to select an additional rinse process as part of the water cleaning process 600. In another embodiment of the present invention, when the operator selects the drying process 360 the operator is provided with a further option of selecting from either the basket drying process 700 or a timed basket drying process 705.

Figure 12:
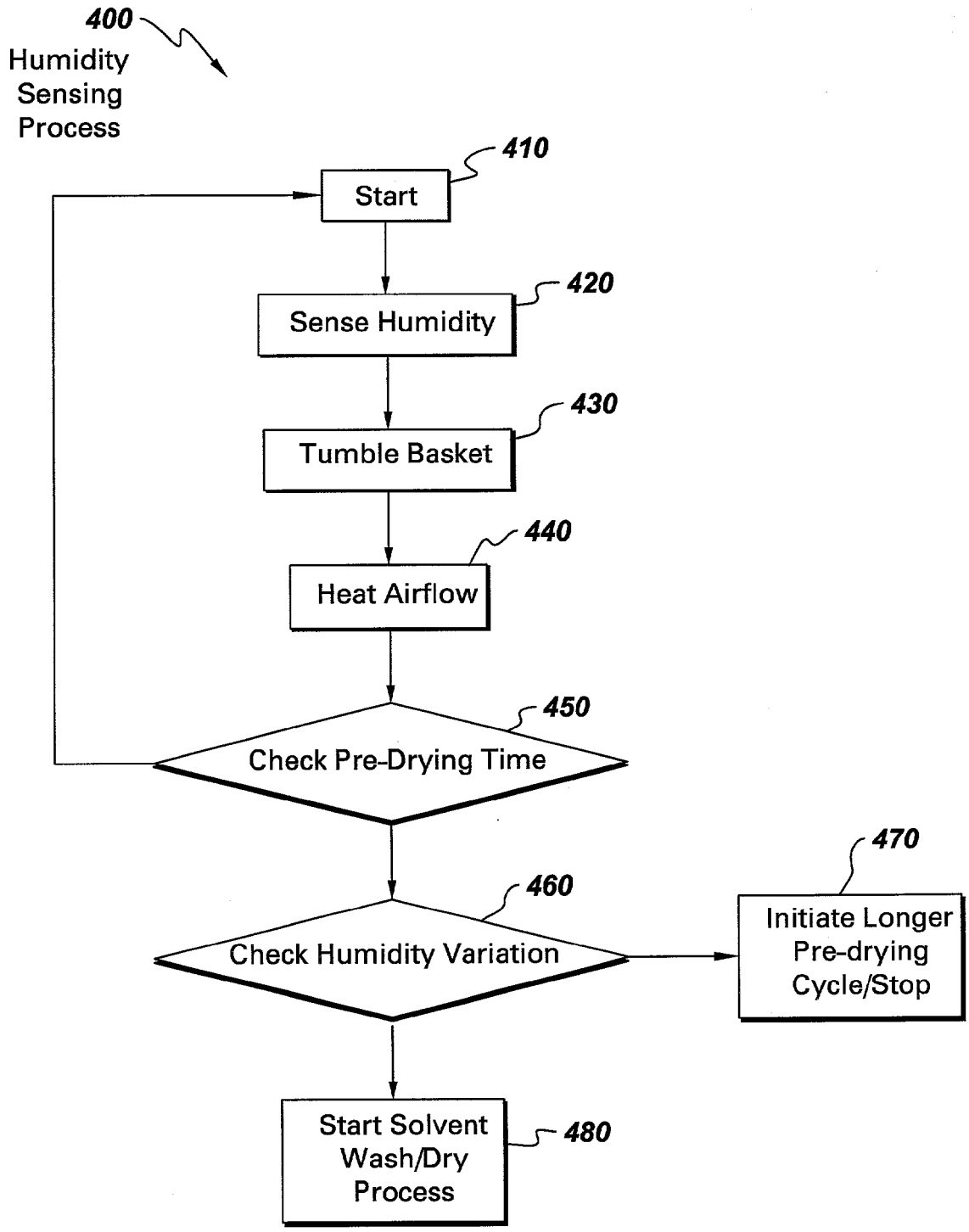
FIG. 12 is a flow diagram of a humidity sensing process in accordance with one embodiment of the present invention.

The start of the solvent based cleaning cycle 375 of FIG. 11 starts with the controller 5 of FIG. 7 sensing the humidity in the rotating basket 14 of FIG. 8 by initiating the humidity sensing process 400 of FIG. 12. The start 410 of the humidity sensing process 400 initially begins by verifying that the door lock 19 is locked. A starting humidity in the rotating basket 14 of FIG. 8 is determined in the sensing humidity step 410 of FIG. 12 by the basket humidity sensor 173. The controller 5 of FIG. 7 then tumbles the rotating basket 14 in step 430 of FIG. 12. The airflow 53 of FIG. 5 is heated and passed through the air management mechanism 1 and the cleaning basket assembly 2 while tumbling the rotating basket 14 for a predetermined pre-drying time in step 440 of FIG. 12. The moisture in the rotating basket 14 becomes vapor. The airflow 53 containing the vapor comes out of the rotating basket 14 through the holes 17 of FIG. 8 and then passes through the lint filter 60. The airflow 53 of FIG. 5 subsequently passes over the cooling coil 65 where the vapor condenses to form condensate. The rotating basket 14 is tumbled and the airflow 53 entering the cleaning basket assembly 2 is heated for the predetermined amount of time. The controller 5 of FIG. 7 then determines a finishing humidity in the rotating basket 14 of FIG. 8. If the controller 5 of FIG. 7 determines that the finishing humidity is too high, then the controller 5 of FIG. 7 sends a warning in step 470 of FIG. 12 to the operator at the display panel 200 indicating that it may take longer to complete the solvent cleaning process 375 and a longer humidity sensing process 400 is initiated.

After completing the humidity sensing process 400, the solvent wash/dry process 500 of FIG. 13 is typically executed. The following typical solvent wash/dry process 500 of FIG. 13 is utilized in one embodiment of the present invention. The following steps of the solvent wash/dry process 500 are provided for illustration and in no way implies any restriction to the present invention. The initial conditions at the start step 510 include reverifying that the door lock 19 of FIG. 8 is locked. The solvent based cleaning fluid 30 of FIG. 2 is added to the rotating basket 14 of FIG. 8 as depicted in step 520 of FIG. 13 and as described in detail above. The rotating basket 14 of FIG. 8 is then tumbled as shown in step 530 of FIG. 13. After tumbling for a predetermined amount of time, the controller 5 of FIG. 7 opens the check valve 40, and the solvent based cleaning fluid 30 of FIG. 2 starts to drain from the rotating basket 14 of FIG. 8. Substantially all of the remaining portion of the solvent based cleaning fluid 30 of FIG. 2 is spin extracted by spinning the rotating basket 14 in step 540 of FIG. 13. The solvent based cleaning fluid 30 is drained to the working tank 45 and subsequently the controller 5 of FIG. 7 shuts the check valve 40 of FIG. 2.

The solvent vapor pressure in the rotating basket 14 of FIG. 8 is determined in step 560 of FIG. 13. The controller 5 of FIG. 7 then tumbles the rotating basket 14 and raises the temperature of the airflow 53 of FIG. 5 in step 570 of FIG. 13. A substantial amount of the remaining portion of the solvent based cleaning fluid 30 and any liquid becomes vapor. The vapor flows from the rotating basket 14 through the lint filter 60 and passes over the cooling coil 65. The vapor condenses on the cooling coil 65 to form a condensate. The post-drying solvent vapor pressure in the rotating basket 14 of FIG. 8 is determined in step 580 of FIG. 13. The process steps of 560 through 580 FIG. 13 as detailed above are performed until the post-drying solvent vapor pressure in the rotating basket 14 of FIG. 8 reaches an acceptable level, at which point the controller 5 of FIG. 7 unlocks the basket door 15 in step 590 of FIG. 13. In another embodiment of the present invention, the operator selects the additional solvent wash process. The additional solvent wash process comprises completing step 520, step 530, and step 540 occurs after completing step 540 and before performing step 560, where the individual steps are as described above. In one embodiment of the present invention, the additional solvent wash process enhances the cleaning performance of especially soiled articles. In another embodiment of the present invention, the additional solvent wash process enhances the removal of cleaning agents. The operator selects the additional solvent wash process at the operator interface 190.

In one embodiment of the present invention the rotating basket 14 of FIG. 8 has a typical load range between about 0.9 kg and about 6.8 kg. The rotating basket 14 has a rotating basket capacity with a typical range between about 17 liters and about 133 liters, which is generally useful for performing laundering utilizing the solvent based cleaning fluid 30 of FIG. 2. The ratio of liters of solvent based cleaning fluid 30 per kg of articles in the laundry load is generally in a range from about 4.2 liters/kg to about 12.5 liters/kg. The corresponding total capacity of the solvent based cleaning fluid 30 per laundry load is generally in a range from about 3.8 liters (4.2 liters/kg times 0.9 kg) to about 85 liters (12.5 liters/kg times 6.8 kg), respectively. The total amount of solvent based cleaning fluid 30 in the article cleaning apparatus 1000 of FIG. 1 is from about 1.05 to about 2.0 times the amount of solvent based cleaning fluid 30 of FIG. 2 required per load. The total amount of solvent based cleaning fluid 30 equates to a range from about 4 liters (3.8 liters times 1.05) to about 170 liters (85 liters times 2), which corresponds to a typical ratio of the capacity of the solvent based cleaning fluid 30 to laundry load ranges from about 4.4 liters/kg (4 liters/0.9 kg) to about 25 liters/kg (170 liters/6.8 kg), respectively.

In another embodiment, the typical amount of articles in a laundry load range from about 2.7 kg to about 5.4 kg. The corresponding total capacity of the solvent based cleaning fluid 30 per laundry load is generally in a range from about 11.3 liters (4.2 liters/kg times 2.7 kg) to about 67.5 liters (12.5 liters/kg times 5.4 kg). The total amount of solvent based cleaning fluid 30 in the article cleaning apparatus 1000 of FIG. 1 is from about 1.05 to about 2.0 times the amount of solvent based cleaning fluid 30 of FIG. 2 required per load. The total amount of solvent based cleaning fluid 30 equates to a range from about 11.9 liters (11.3 liters times 1.05) to about 135 liters (67.5 liters times 2).

In another embodiment, the ratio of liters of solvent based cleaning fluid 30 of FIG. 2 to kg of articles is from about 6.7 liters/kg to about 8.3 liters/kg. When the load capacity is in a range from about 0.9 kg to about 6.8 kg, the corresponding total capacity of the solvent based cleaning fluid 30 per laundry load is generally in a range from about 6.0 liters (6.7 liters/kg times 0.9 kg) to about 56.4 liters (8.3 liters/kg times 6.8 kg), respectively. When the load capacity is in a range from about 2.7 kg to about 5.4 kg, the corresponding total capacity of the solvent based cleaning fluid 30 per laundry load is generally in a range from about 18.1 liters (6.7 liters/kg times 2.7 kg) to about 44.8 liters (8.3 liters/kg times 5.4 kg), respectively. The total amount of solvent based cleaning fluid 30 in the article cleaning apparatus 1000 of FIG. 1 is from about 1.05 to about 2.0 times the amount of solvent based cleaning fluid 30 of FIG. 2 required per load. The total amount of solvent based cleaning fluid 30 equates to a range from about 6.3 liters (6.0 liters times 1.05) to about 112.8 liters (56.4 liters times 2).

In order to reduce the total capacity of the solvent based cleaning fluid 30 in the article cleaning apparatus 1000 of FIG. 1, the cleaning fluid processing is performed on-line and the processing is synchronized with the solvent wash/dry process 500 of FIG. 13. Processing the solvent based cleaning fluid 30 of FIG. 2 on-line typically provides sufficient solvent based cleaning fluid 30 in the storage tank 35 to perform a subsequent solvent cleaning process 350 of FIG. 11 after completing the previous solvent cleaning process 350. The storage tank 35 of FIG. 2 typically has a sufficient capacity of the solvent based cleaning fluid 30 to make up for any solvent based cleaning fluid 30 that is held up in the fluid regeneration device 7, in the working fluid device 6, and retention in the "dried" articles. The regeneration cartridge 141 is capable of replenishing the amount of solvent based cleaning fluid 30 that is retained in the "dried" articles. In one embodiment of the present invention, the typical solvent capacity of the storage tank 35 is from about 10.4 liters/kg to about 12.5 liters/kg when the load capacity ranges from about 2.7 kg to about 5.4 kg. The storage tank 35 has a corresponding typical range from about 28.1 liters to about 67.5 liters. Therefore, the storage tank 35 of the present invention typically needs only about 36% (67.5 liter/190 liter) of the capacity of the about 190 liter storage tank found in typical commercial chemical fluid dry cleaning machines. In one embodiment of the present invention, the typical solvent capacity of the storage tank 35 is from about 10.4 liters/kg to about 12.5 liters/kg when the load capacity ranges from about 0.9 kg to about 6.8 kg. The storage tank 35 has a corresponding typical range from about 9.4 liters to about 85 liters. Therefore, the storage tank 35 of the present invention typically needs only about 45% (85 liter/190 liter) of the capacity of the about 190 liter storage tank found in typical commercial chemical fluid dry cleaning machines. The above comparison of storage tank capacity typical range from about 9.4 liters to about 85 liters for the present invention compares favorably to the range of the storage tank capacity of from about 190 liters to about 1325 liters for typical commercial chemical fluid dry cleaning machines.

In another embodiment of the present invention, the solvent wash/dry process 500 adds water to the solvent based cleaning fluid 30 of FIG. 2 in the rotating basket 14, where the maximum amount of water added is in the range from about 1 percent to about 8 percent of the total weight of the solvent based cleaning fluid 30 that is in the rotating basket 14. Adding the water to the solvent based cleaning fluid 30 that is in the rotating basket 14 is performed as described above. In another embodiment of the present invention, the solvent wash/dry process 500 adds water and cleaning agents to the solvent based cleaning fluid 30 of FIG. 2 in the rotating basket 14, where the maximum amount of water added does not exceed a maximum of about 8 percent of the total weight of the solvent based cleaning fluid 30 that is in the rotating basket 14. Adding the water and the cleaning agents to the solvent based cleaning fluid 30 that is in the rotating basket 14 is performed as described above.

Steps 560 of FIG. 13 through 580 in the solvent wash/dry process 500 require a typical range from about 15 minutes to about 60 minutes for the typical laundry load, which ranges from about 0.9 kg of articles to about 6.8 kg of articles. The sensible heat required to dry the clothes, which is the principle source of total electrical power the machine requires, is in a range between about 430 watts to about 6300 watts. As used herein, the term, "sensible heat" is defined to be the total amount of heat added by the combination of the heater 55 and auxiliary heater 158 (if installed). In another embodiment, the drying time is between about 20 and about 60 minutes with the typical laundry load range between about 2.7 kg of articles and about 5.4 kg of articles. In this case, the sensible heat required to dry the clothes is in a range between about 1300 watts and about 5200 watts. In each of these cases, the power is easily handled on a household circuit with a maximum voltage of about 240V and a maximum amp rating of about 30 amps. In some embodiments, the article cleaning apparatus 1000 of FIG. 1 is configured to run on about 220V service in an about 20-amp circuit, about 220V service in an about 30-amp circuit, and about 110V service and in a circuit having a amperage range from about 15 amps to about 20 amps. All of these circuit types are typically available in homes for currently available cooking and drying appliances; therefore, presenting no additional installation difficulties.

The controller 5 of FIG. 7 controls the water cleaning process 600 of FIG. 14. The controller 5 of FIG. 7 is configured to reduce the opportunity for introducing large amounts of water into the working tank 45 of FIG. 2 as discussed herein. In the present invention, a fluid in the rotating basket 14 is defined to contain a "large amount of water" when the fluid comprises greater than about 10% water by weight. The water cleaning process 600 of FIG. 14 is provided to illustrate a series of steps used in one embodiment of the present invention and in no way implies any limitation to the water cleaning process 600 utilized in the present invention.

The water cleaning process 600 begins with the initial conditions of the cleaning agents loaded into the dispenser 300, and the door lock 19 engaged and the door lock sensor 18 verifying that the basket door 15 in the locked position at the start step 610 of FIG. 14. Water and cleaning agents are added to the rotating basket 14 to produce the water based cleaning fluid 31 of FIG. 9 in step 620. The water may be hot, cold or a mixture as detailed above. The rotating basket 14 is tumbled in step 630 of FIG. 14. Substantially all of the water based cleaning fluid 31 of FIG. 9 is spin extracted by rotating from the rotating basket 14 of FIG. 2 in step 640 of FIG. 14. The controller 5 of FIG. 7 opens the water drain valve 260 of FIG. 2 and operates the regeneration pump 115 as necessary to drain the rotating basket 14 during the spin step 640, when the basket conductivity cell 170 of FIG. 8 detects that the water based cleaning fluid 31 of FIG. 9 in the rotating basket 14 comprises greater than about 10% water by weight. The controller 5 of FIG. 7 closes the water drain valve 260 of FIG. 2 after removing the water based cleaning fluid 31 of FIG. 9 from the rotating basket 14 of FIG. 2 after completing the spin basket step 640.

Rinse water is then added to the rotating basket 14 of FIG. 8 and the rotating basket 14 is tumbled in step 670 of FIG. 14. The temperature of the rinse water is determined by the controller 5 of FIG. 7 in conjunction with the mixing valve 185 of FIG. 8. Substantially all of the remaining amount of rinse water is spin extracted by spinning the rotating basket 14 in step 680 of FIG. 14. The rinse water is removed as described above. The rotating basket 14 is tumbled in step 690 of FIG. 14. The basket door 15 of FIG. 8 is then unlocked in step 695 of FIG. 14.

In another embodiment of the present invention, the operator selects an additional rinse process. The additional rinse process reperforms step 670, step 680, and step 690. The additional rinse process occurs after step 690 and before the basket door 15 is unlocked in step 695. The additional rinse process assists in removing the entrained cleaning agents that are not removed during steps 670, 680, and 690. The additional rinse process is especially useful when using soft water. As used herein, the term "soft water" is defined as comprising less than about 10 grains of hardness per about 3.8 liters of water.

Figure 15:
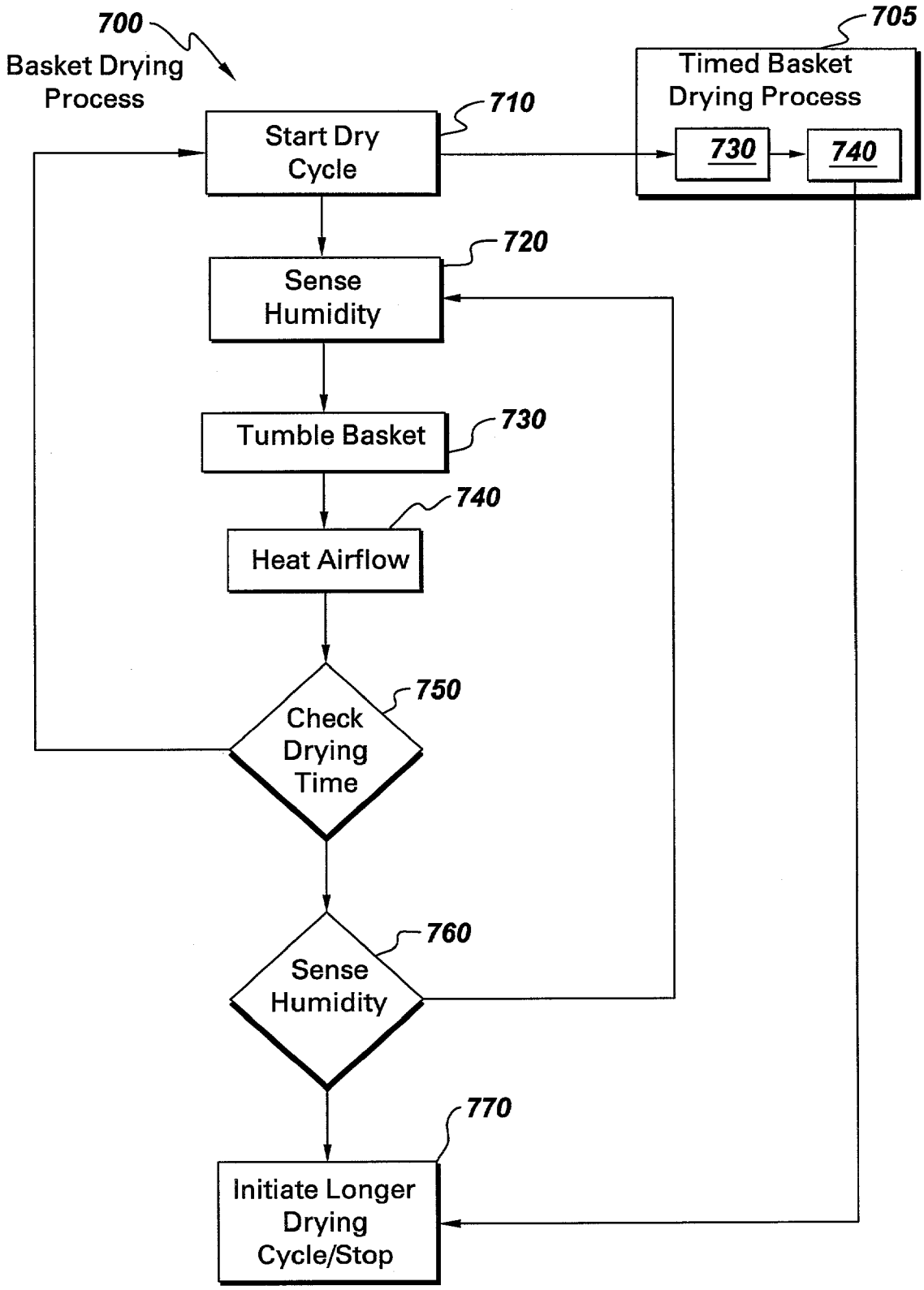
FIG. 15 is a flow diagram of a basket drying process in accordance with one embodiment of the present invention.

In another embodiment of the present invention, the article cleaning apparatus 1000 of FIG. 1 is configured to perform the basket drying process 700 of FIG. 15. The basket drying process 700 of FIG. 15 is provided to illustrate the basket drying process 700 used in one embodiment of the present invention and in no way implies any limitation to the basket drying process 700 of the present invention. The basket drying process 700 begins with the initial conditions of the basket door 15 locked, and the door lock sensor 18 verifying the basket door 15 locked at the start step 710 of FIG. 15. The basket drying process 700 initially begins by performing a sensing humidity step 720 to determine a start humidity, a tumble basket step 730 and heat airflow step 740 similar to that described above in steps 420, 430, and 440, respectively. After tumbling and heating the airflow 53 for a predetermined post-water wash drying time, the controller 5 of FIG. 7 determines a final humidity in the rotating basket 14 of FIG. 8 in step 760. When the controller 5 of FIG. 7 determines that the final humidity is too high, then the controller 5 initiates a longer drying sequence in step 760 by re-performing steps 730 through 760. When the final humidity is acceptable, the controller 5 of FIG. 7 stops the basket drying process 700 of FIG. 15 in step 770, and unlocks the basket door 15 of FIG. 8 in step 780 of FIG. 15.

In another embodiment of the present invention, a timed basket drying process 705 of FIG. 11 is available to the operator at the operator interface 190. The timed basket drying process 705 comprises the steps of starting the drying cycle 710 of FIG. 15 by setting the predetermined amount of drying time, tumbling the rotating basket 14 in step 730, heating the airflow 53 in step 740, and stopping the timed basket drying process in step 770 when predetermined amount of drying time is accomplished. The controller 5 of FIG. 7 unlocks the basket door 15 of FIG. 8 in step 780 of FIG. 15.

It is important that a large amount of the water is not inadvertently directed to the working tank 45 of FIG. 2 during the solvent wash/dry process 500 of FIG. 13 that adds water, in the range from about 1 percent to about 8 percent, to the solvent based cleaning fluid 30 of FIG. 2 in the rotating basket 14 as discussed above. It is also important to reduce the possibility that the solvent based cleaning fluid 30 is not accidentally pumped out of the article cleaning apparatus 1000 of FIG. 1. If the solvent cleaning process 375 of FIG. 11 or the water cleaning process 600 is interrupted by either the operator or a loss of electrical power, the controller 5 of FIG. 7 utilizes a cycle interruption recovery process 800 of FIG. 16. The cycle interruption recovery process 800 operates a series of logical sequence options to control the subsequent operation of the article cleaning apparatus 1000 of FIG. 1. The logical sequence options include completing the appropriate cleaning cycle, completing a fail-safe process, or informing the operator to call service.

Figure 16:
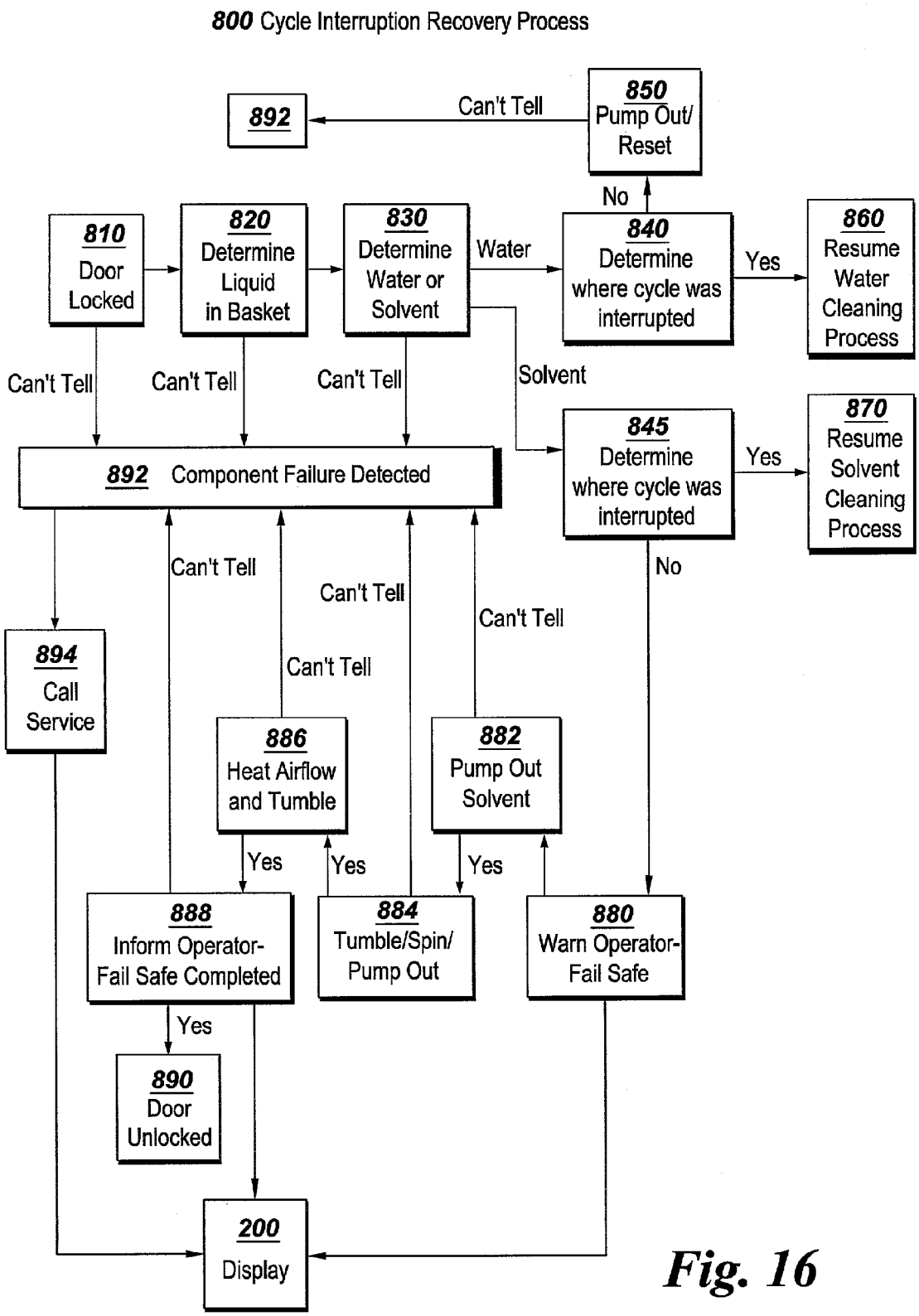
FIG. 16 is a flow diagram of a cycle interruption recovery process in accordance with one embodiment of the present invention.

In one embodiment of the present invention, the cycle interruption recovery process 800 starts by verifying the locked status of door lock 19 of FIG. 8 via the door lock sensor 18 in step 810 of FIG. 16. If the door lock sensor 18 of FIG. 8 is determined to be non-operational in the component failure detected step 892 of FIG. 16, then a call service message is generated in step 894, which is then sent to the display 200. Conversely, if the controller 5 of FIG. 7 does verify that the door lock 19 of FIG. 8 is locked in step 810 of FIG. 16, then the basket level detector 172 of FIG. 8 determines if there is liquid in the rotating basket 14 in step 820 of FIG. 16. If the controller 5 cannot tell if the basket level detector 172 is operational, then the component failure detected step 892 of FIG. 16 generates the call service message in step 894. If liquid is detected in step 820 of FIG. 16 then the basket conductivity cell 170 of FIG. 8 determines whether the liquid is the solvent based cleaning fluid 30 or the water based cleaning fluid 31 in step 830 of FIG. 16. Siloxane is non-conductive; therefore, the basket conductivity cell 170 of FIG. 8 typically provides a conductivity measurement of the liquid in the article cleaning apparatus 1000. If the controller 5 cannot tell if the basket conductivity cell 170 of FIG. 8 is operational, then the component failure detected step 892 of FIG. 16 generates a call service message in step 894.

If the basket conductivity cell 170 of FIG. 8 detects that the fluid in the rotating basket 14 comprises greater than about 10% water, then the fluid is defined to be the water based cleaning fluid 31. If the fluid in the rotating basket 14 is defined to be the water based cleaning fluid 31, then a determination of where the interruption occurred in the water cleaning process 600 is performed in step 840. In step 840, if the controller 5 of FIG. 7 has a memory of where the water cleaning process interruption occurred, then the water cleaning process 600 resumes as depicted in step 860. If the controller 5 in step 840 of FIG. 16 cannot remember where the water cleaning process interruption occurred, then the water based cleaning fluid 31 is pumped out and the cleaning process 350 of FIG. 11 is reset in step 850 of FIG. 16. If the controller 5 in step 850 of FIG. 16 cannot tell if the components required to perform step 850 are available, then the component failure detected step 892 generates the call service message in step 894.

If the basket conductivity cell 170 of FIG. 8 detects less than about 10% water in the liquid in the rotating basket 14, then the liquid is defined to be the solvent based cleaning fluid 30. If the liquid is defined to be the solvent based cleaning fluid 30, then a determination of where the interruption occurred in the solvent cleaning process 375 is performed in step 845. In step 845, if the controller 5 of FIG. 7 has a memory of where the solvent cleaning process interruption occurred, then the solvent cleaning process 375 resumes as depicted in step 870. If the controller 5 of FIG. 7 in step 845 of FIG. 16 cannot determine where the interruption occurred in the solvent cleaning process 375 of FIG. 11, then a warn operator fail-safe message is generated in step 880, which is then set to the display 200 of FIG. 9.

After generating the warn operator fail-safe message in step 880 of FIG. 16, the solvent based cleaning fluid 30 of FIG. 2 is pumped out in step 882 of FIG. 16. Subsequently the rotating basket 14 of FIG. 8 is tumbled and rotated to spin extract substantially all of the remaining portion of the solvent based cleaning fluid 30 of FIG. 2 from the rotating basket 14 in step 884 of FIG. 16. The airflow 53 is then heated while tumbling the rotating basket 14 of FIG. 8 in step 886 of FIG. 16. The operator is informed that the fail-safe is completed in step 888, and the fail-safe completed message is sent to the display 200 of FIG. 9, and the basket door 15 of FIG. 8 is unlocked in step 890 of FIG. 16. If it is determined that the components required to operate each of the steps 882, 884, 886, and 888 are non-operational, then the component failure detected step 892 of FIG. 16 generates the call service message in step 894.

The cycle interruption recovery process 800 of FIG. 16 is provided to illustrate the cycle interruption recovery process 800 used in one embodiment of the present invention and in no way implies that any limitation to the cycle interruption recovery process 800 employed in controlling operation of article cleaning apparatus 1000 of FIG. 1 of the present invention.

The foregoing description of several embodiments of the article cleaning apparatus 1000 and the method of using the article cleaning apparatus 1000 of the present invention has been presented for purposes of illustration. Although the invention has been described and illustrated in detail, it is to be clearly understood that the same is intended by way of illustration and example only and is not to be taken by way of limitation. Obviously many modifications and variations of the present invention are possible in light of the above teaching. Accordingly, the spirit and scope of the present invention are to be limited only by the terms of the appended claims.

The invention claimed is:

1. An article cleaning apparatus comprising:

an air management mechanism having a cooling coil and a drain tray disposed under said cooling coil;

a cleaning basket assembly;

a fluid regeneration device;

a working fluid device coupled to said fluid regeneration device, and said cleaning basket assembly, and said air management mechanism; said working fluid device including a working tank, a regeneration pump, a conductivity sensor, a waste water drain valve, wherein said regeneration pump is disposed between said working tank and said conductivity sensor, wherein said waste water drain valve is disposed between said conductivity sensor and said fluid regeneration device, and wherein said waste water drain valve is coupled to waste water discharge piping, a first drain conduit disposed between said cleaning basket assembly and said working tank, and a valve wherein said valve is disposed in said drain conduit;

a clean fluid device coupled to said cleaning basket assembly and said fluid regeneration device; and a second drain conduit disposed between said drain tray and said working tank.

2. The apparatus of claim 1, wherein said working fluid device further comprises a water separator, wherein said water separator is disposed in said working tank.

3. The apparatus of claim 1, wherein said working fluid device further comprises a water separator, wherein said water separator is disposed between said waste water drain valve and said fluid regeneration device.

4. The apparatus of claim 3, wherein said water separator is fabricated from materials selected from the group consisting of calcined clay, water adsorbing polymers, sodium sulfate, paper, cotton fiber, lint, and any combination thereof.

5. The apparatus of claim 1, wherein said cleaning basket assembly has a load capacity in a range from about 0.9 kg of articles to about 6.8 kg of said articles.

6. The apparatus of claim 5, wherein a range of sensible heat from about 430 watts to about 6300 watts is required to dry said articles.

7. The apparatus of claim 1, wherein said cleaning basket assembly has a load capacity in a range from about 2.7 kg of articles to about 5.4 kg of articles.

8. The apparatus of claim 7, wherein a range of sensible heat from about 1300 watts to about 5200 watts is required to dry said articles.

9. The article cleaning apparatus of claim 1, further comprising:

a controller configured to control a cleaning process, wherein said controller is coupled to said cleaning basket assembly, said working fluid device, said regeneration device, said clean fluid device, and said valve.

10. The apparatus of claim 9, wherein said controller is further configured to direct a working fluid stored in said working tank through said conductivity sensor, said waste water drain valve, and said waste water discharge piping when said working fluid flowing through said conductivity sensor comprises at least about 10% water by weight so as to not overwhelm said fluid regeneration device.

11. The apparatus of claim 9, wherein said controller is further configured to direct a working fluid stored in said working tank through said conductivity sensor, said waste water drain valve, and said water separator to said fluid regeneration device when said conductivity sensor indicates that said working fluid comprises less than about 10% water by weight.

* * * * *